US011873137B1

(12) United States Patent
Yosufy

(10) Patent No.: US 11,873,137 B1
(45) Date of Patent: Jan. 16, 2024

(54) BAG WITH MULTIPLE SEAL SYSTEM

(71) Applicant: Sal Yosufy, Elk Grove, CA (US)

(72) Inventor: Sal Yosufy, Elk Grove, CA (US)

( * ) Notice: Subject to any disclaimer, the term of this patent is extended or adjusted under 35 U.S.C. 154(b) by 0 days.

(21) Appl. No.: 17/731,370

(22) Filed: Apr. 28, 2022

Related U.S. Application Data

(63) Continuation-in-part of application No. 16/751,054, filed on Jan. 23, 2020, now abandoned.

(51) Int. Cl.

| | |
|---|---|
| ***B65D 33/00*** | (2006.01) |
| ***B65D 33/16*** | (2006.01) |
| ***B65D 33/06*** | (2006.01) |
| ***B65D 33/04*** | (2006.01) |

(52) U.S. Cl.
CPC ..... *B65D 33/1683* (2013.01); *B65D 33/004* (2013.01); *B65D 33/04* (2013.01); *B65D 33/06* (2013.01); *B65D 2203/12* (2013.01)

(58) Field of Classification Search
CPC .. B65D 33/1683; B65D 33/004; B65D 33/04; B65D 33/06; B65D 2203/12
USPC ..... 383/203
See application file for complete search history.

(56) References Cited

U.S. PATENT DOCUMENTS 1,751,473 A * 3/1930 Deubener ..... B65D 33/10 383/17
3,227,358 A * 1/1966 Laguerre ..... B65D 33/1683 24/33 B
3,363,827 A * 1/1968 Renner ..... B65D 33/1683 D9/434
3,486,683 A * 12/1969 Seymour ..... B65D 33/1683 248/340
4,707,883 A * 11/1987 Irani ..... B65D 33/1683 16/407
4,860,899 A * 8/1989 McKee ..... G11B 33/0494 206/390
4,948,266 A * 8/1990 Bencic ..... A47L 9/1445 294/1.3
5,088,667 A * 2/1992 Olson ..... B65B 67/1244 248/101
6,139,187 A * 10/2000 Galomb ..... B65D 33/16 383/81
6,164,821 A * 12/2000 Randall ..... B65D 77/20 150/120
6,296,388 B1 * 10/2001 Galomb ..... B65D 77/12 383/65
6,345,911 B1 * 2/2002 Young ..... B65D 33/10 383/44

(Continued)

*Primary Examiner* — Peter N Helvey
(74) *Attorney, Agent, or Firm* — Sandy Lipkin

(57) ABSTRACT

Disclosed herein a bag with a multiple seal system. Accordingly, the bag may include a container and a seal. Further, the container may include a bottom side, a first imprinted surface, a second imprinted surface, a plurality of side surfaces and a cavity. Further, the first imprinted surface may include a first imprinted media. Further, the second imprinted surface may include a second imprinted media. Further, the bottom side may include a plurality of vertexes. Further, the cavity may be configured for storing an item. Further, the seal may be configured for preventing access to the cavity. Further, the seal may include a male side and a female side. Further, a male side of the seal may be located on a first member of the plurality of top edges. Further, a female side of the seal may be located on a second member of the plurality of top edges.

8 Claims, 21 Drawing Sheets

(56) References Cited

U.S. PATENT DOCUMENTS

| | | | | | |
|---|---|---|---|---|---|
| D551,565 | S | * | 9/2007 | Wouters | D9/704 |
| D636,988 | S | * | 5/2011 | Romero | D3/232 |
| 8,142,075 | B2 | * | 3/2012 | Shaw | B65D 33/1691 383/34 |
| 8,695,793 | B2 | * | 4/2014 | Saggar | B65D 33/007 206/812 |
| D718,931 | S | * | 12/2014 | Brundl | D3/232 |
| D724,836 | S | * | 3/2015 | Thai | D3/232 |
| D745,268 | S | * | 12/2015 | Slimane | D3/232 |
| 9,315,297 | B2 | * | 4/2016 | Jönsson | B65D 77/12 |
| 10,259,616 | B2 | * | 4/2019 | Korinek | B65D 33/02 |
| D856,665 | S | * | 8/2019 | Tooze | D3/232 |

* cited by examiner

BAG WITH MULTIPLE SEAL SYSTEM

REFERENCE TO PRIOR APPLICATION

This application is a continuation-in-part of U.S. patent application Ser. No. 16/751,054, entitled BAG WITH MULTIPLE SEAL SYSTEM on Jan. 23, 2020 by Sal Yosufy.

FIELD OF THE INVENTION

Generally, the present disclosure relates to the field of bags. More specifically, the present disclosure relates to a bag with a multiple seal system.

BACKGROUND OF THE INVENTION

For individuals with disabilities, storing items (such as food) can be a difficult task. Current technologies for storing the items are difficult to use for the individuals with disabilities. Food containers are difficult to access for an individual with disabilities because they may struggle with taking lid on or off. Plastic bags may be comparatively easier to access for an individual with disabilities, but the plastic bags lack rigidity and reusability making them inefficient for storing the food. Furthermore, there is no current storage options that have imprinted braille.

Therefore, there is a need for an improved bag with a multiple seal system that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a bag with a multiple seal system, in accordance with some embodiments. Accordingly, the bag may include a container and a seal. Further, the container may include a bottom side, a first imprinted surface, a second imprinted surface, a plurality of side surfaces and a cavity. Further, the first imprinted surface may include a first imprinted media. Further, the second imprinted surface may include a second imprinted media. Further, each side surface of the plurality of side surfaces may be disposed between the first imprinted surface and the second imprinted surface. Further, at least one of the first imprinted media and the second imprinted media may include an imprinted braille. Further, the bottom side may include a plurality of vertexes.

Further, the plurality of vertexes connects the bottom side to the first imprinted surface, the second imprinted surface, and the plurality of side surfaces to form the cavity. Further, the cavity may be configured for storing an item. Further, the cavity may include a plurality of top edges. Further, the seal may be configured for preventing access to the cavity. Further, the seal may include a male side and a female side. Further, a male side of the seal may be located on a first member of the plurality of top edges.

Further, a female side of the seal may be located on a second member of the plurality of top edges. Further, the male side may include a ridge, a knob, and a first handle. Further, the ridge may be positioned between the knob and the first handle. Further, the female side may include a canal, a knob receiver, and a second handle. Further, the canal may be positioned between the knob receiver and the second handle. Further, the ridge engages with the canal to prevent access to the cavity. Further, the male side and the female side are detachably couplable.

Further disclosed herein is a bag with a multiple seal system, in accordance with some embodiments. Accordingly, the bag may include a container and a seal. Further, the container may include a bottom side, a first imprinted surface, a second imprinted surface, a plurality of side surfaces and a cavity. Further, the first imprinted surface may include a first imprinted media. Further, the second imprinted surface may include a second imprinted media. Further, each side surface of the plurality of side surfaces may be disposed between the first imprinted surface and the second imprinted surface. Further, the first imprinted media of the first imprinted surface may include an imprinted measurement system and the second imprinted media of the second imprinted surface may include a calendar. Further, the imprinted measurement system may be configured to measure quantity of an item stored in the container. Further, the calendar facilitates tracking of storage and expiration dates of the item stored in the container. Further, at least one of the first imprinted media and the second imprinted media may include an imprinted braille. Further, the bottom side may include a plurality of vertexes. Further, the plurality of vertexes connects the bottom side to the first imprinted surface, the second imprinted surface, and the plurality of side surfaces to form the cavity. Further, the cavity may be configured for storing the item. Further, the cavity may include a plurality of top edges. Further, the seal may be configured for preventing access to the cavity. Further, the seal may include a male side and a female side. Further, a male side of the seal may be located on a first member of the plurality of top edges. Further, a female side of the seal may be s located on a second member of the plurality of top edges. Further, the male side may include a ridge, a knob, and a first handle. Further, the ridge may be positioned between the knob and the first handle. Further, the female side may include a canal, a knob receiver, and a second handle. Further, the canal may be positioned between the knob receiver and the second handle. Further, the ridge engages with the canal to prevent access to the cavity. Further, the male side and the female side are detachably couplable.

Both the foregoing summary and the following detailed description provide examples and are explanatory only.

Accordingly, the foregoing summary and the following detailed description should not be considered to be restrictive. Further, features or variations may be provided in addition to those set forth herein. For example, embodiments may be directed to various feature combinations and sub combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose. Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
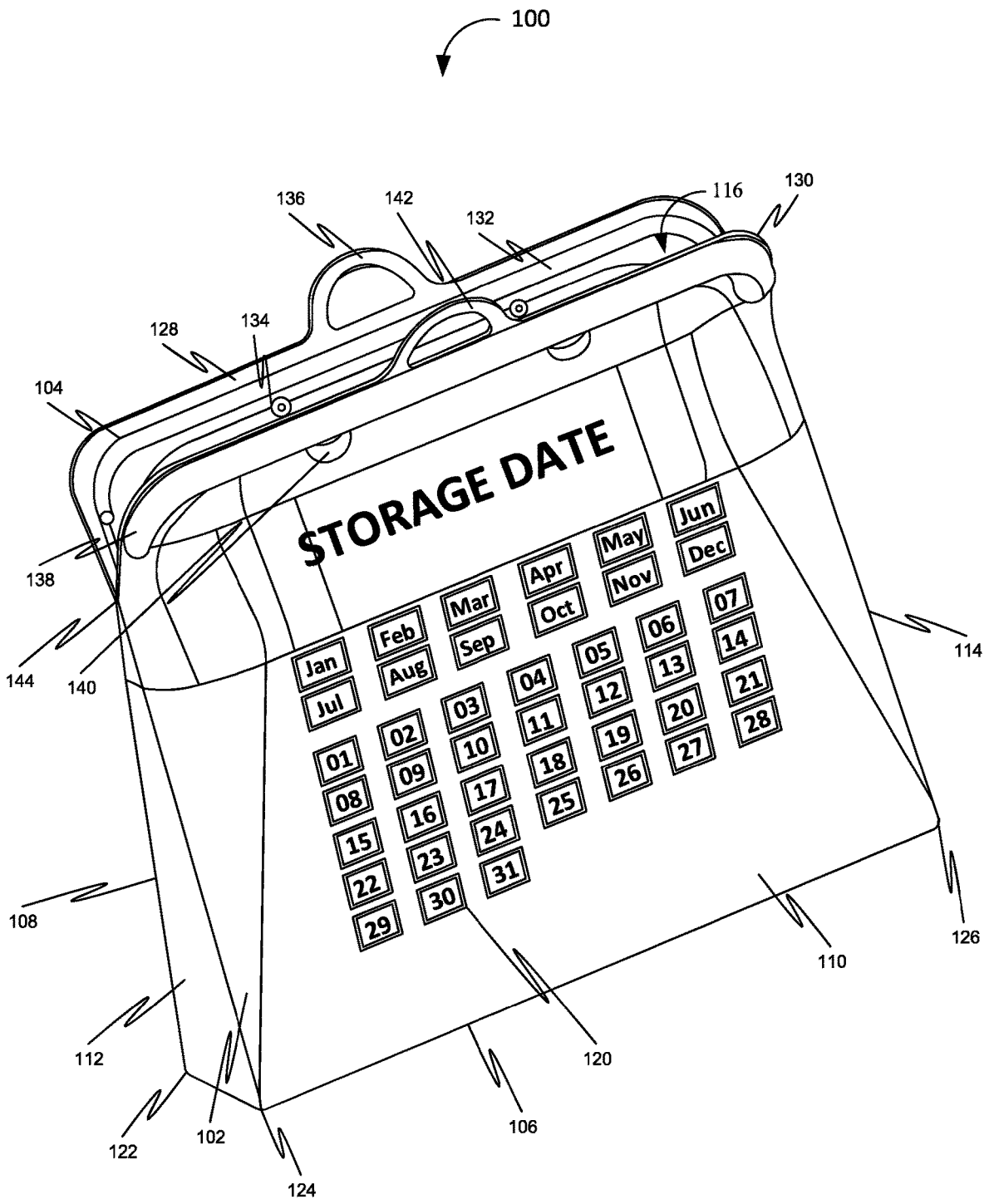
FIG. 1 is a rear right side perspective view of a bag with a multiple seal system, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive.

Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a bag with a multiple seal system, embodiments of the present disclosure are not limited to use only in this context.

Overview:

The present disclosure describes a bag with a multiple seal system. Further, the bag may have a partially rigid structure making it convenient for an individual with disabilities to store food in the bag. Further, the bag may be made from a reusable material and easily accessible to the individual with disabilities. Further, the bag may be utilized as a food container that is at least partially rigid and easy to use for the individual with disabilities.

Under the brand name of Innovative Silicone Bags (ISBs), the present disclosure introduces a new class of functionality and design in shopping bags, and storage helpers to the market. Further, the present disclosure focuses on the following two vital elements: a) customer convenience and satisfaction in product utilization, and b) environmental sustainability in both, production and utilization of products.

The innovative character and functionality of the aforementioned bags may be achieved by a combination of material and design. Innovative silicone bags may be introduced to the market offering the public consumer a versatile alternative to replace presently existing one-way solutions. These are currently dominated by polyethylene and vinyl chloride plastic or cellulose carrier bags. It is firmly intended to reduce and to stop the ongoing contamination of terrestrial, limnic and marine ecosystems with plastic or microplastic detritus.

For environmental sustainability, the present disclosure requires the designated one-way-carrier-bag substitute to be eco-friendly on both sides of the production process, on the raw material input side and on the finished product output side—and silicone rubber is a perfect match.

Compared to conventional plastics, silicone rubbers have a significantly smaller footprint in energy consumption and greenhouse gas production during production processes. The finished product may be a multi-purpose versatile system of reusable elastomer bags and pouches that helps the individual private consumer as well as the professional caterer to organize shopping and storage needs, respectively.

A color code system in combination with Braille Scripts of a tactile alphabet and the combination of two different closing mechanisms may be to reduce discriminating elements in daily life of the visually impaired or physically disabled.

Innovative silicone freezer/storage/cooking bags may be a safe way for people to store, freeze and cook food in the bag. Silicone is a natural material that is approved by the FDA for use with food. Silicone material is safe for the environment and will not emulate any chemicals when in contact with food for ingestion.

Silicone bags may be an alternative to plastics. The use of plastics is polluting our oceans and causing a lot of damages to our sea life. American households use millions of plastic bags each year to store their foods. Therefore, silicone food storage bags are reusable and may last a long time. Further, the disclosed bag may cut down on the use of plastics around the world. There may be silicone food bags on the market but most of them need a second part to close bags. Mostly these silicone bags on the market use a plastic bar to close the bags. Further, the disclosed bag may be designed as one piece. Further, the disclosed bag may be self-closing and does not need any other part to close the bag.

With silicone bags, a user may cook food directly in the oven and use them in the microwave or the user can just simply freeze food in them. The silicone bags can withstand the heat and the freezing temperatures which makes the silicone bags unique.

Innovative silicone freezer/storage/cooking food bags are made of pure 100 percent food-grade silicone. The body construction of the bags is made from a mold. The shape of the bag depends on the size of the bags. In general, the bags are wide on the bottom for maximum storage use and it narrows towards the top of the bag where there are two bag lips separate from each other that brings the bag to a closed position when pushed in together. When the two lips are pushed together by hand a male tongue insert that sits on one of the lips slides into a female intake canal on the opposite lip for an airtight seal. To open the bag, the user may simply just pull the lips apart from each other. The entire bag may be made in an iron mold. The molds are made specific to the size of the bags that are being produced. An amount of raw silicone may be placed in the mold according to the size of the bag, under pressure and heat which produces the shape of the bag.

Innovative silicone freezer/storage/cooking food bags are made in different shapes and sizes. Further, the different sized bags may have different names such as a snack bag, a sandwich bag, a 2.5-liter bag, a gallon bag, and a cooking bag. All bags have the same closing style. The bags have a few parts that may help to close the bag for airtightness and leak-proof of liquids.

Material Aspects in General: Achieving such goals and to be most competitive, the present disclosure, instead of polyethylene, vinyl-chloride or other highly problematic polymeric hydrocarbons or plastics—exclusively uses silicone rubber compounds. These consist of long-chain polysiloxanes and various fillers, such as pyrogenic silica. They can be cured to form silicone elastomers, also known as food-grade silicone; liquid silicone rubbers are used in an impressive array of applications: from the automotive industry, transmission and distribution, electrical, food and personal care, through the machinery, and plant engineering and construction sectors to medical applications. They are classified according to a curing method, the viscosity of the base polymer, and whether they cure at high or room temperature.

Chemical Structure and Properties of Liquid Silicone Rubber (LSR); Sustainability: The chemical group of high-temperature-vulcanizing rubbers also includes liquid silicone rubbers (HTV silicone rubbers). Their consistency and curing mechanism gives them outstanding processing advantages. Liquid silicone rubbers are characterized by a low viscosity compared to solid silicone rubbers and other elastomers.

The liquid silicone rubbers are free-flowing, pumpable two-component compounds that are supplied ready to process. They are vulcanized by addition curing. Component A contains a Platinum (Pt) catalyst and Component B a (Mono-)Silan (SiH4) functional curing agent.

Compared to peroxide curing, liquid silicone rubbers do not release any curing byproducts; replacing conventional "one-way-plastics" by using HTV-LSR products reduces greenhouse gas production and energy consumption during basic production of the chemical industry.

Commissioned by the Global Silicones Council, a joint study of the Global Silicones Council, the Centre Européen des Silicones, the Silicones Environmental, Health and Safety Council of North America and the Silicone Industry Association of Japan recently looks at the greenhouse-gas (GHG) emissions linked to the entire life cycle of silicone, siloxane and silane products in Europe, North America and Japan. The first of its kind, this study takes a cradle-to-grave perspective, embracing the production, use and waste phases and finding (among others) that: a) using silicones, siloxanes and silane products generates greenhouse-gas emission reductions that outweigh the impacts of production and end-of-life disposal by a factor of 9; and the use of silicon-chemistry products in Europe, North America and Japan yields GHG emission reductions equivalent to about 54 million tons of CO2; this is equivalent to the emissions required to heat 10 million homes in the area covered by the study—or three times the number of households in Greater London.

Product-Specific Aspects: Such raw material provides unique properties, which enable a system of shopping and storage helpers with similar unique selling propositions as follows: Quality: All ISBs are made of Food Grade Silicone to preserve freshness and protect hygiene during transport and storing.

Color: Understanding colors as a basic graphic code system, colors may be helpful assistants in storage issues; they provide fast access to information.

ISBs uses color-coded information in order to save energy by reducing opening intervals of refrigerators and freezers.

ISBs come in five different colors, such that the color code to be used as follows:

a) transparent neutral/all-purpose
b) yellow bread/cakes/pastries, etc.
c) green fruit and vegetables
d) blue fish and seafood
e) red meat Size: For customer convenience, ISBs come in different sizes;

a) small size: "Snack Bag" (500 ml (1 US.liq.pt.))
b) medium size: "Small Shopper" (4.000 ml (1 US.liq. gal.))
c) big size: "Big Shopper" (10 000 ml (2.5 US.liq.gal))
d) XXX size: "Mega Shopper" (25 000 ml (6.5 US.liq-.gal))

Smaller sizes (a through c) are considerably designed for specific utilization of individual customers, i.e. "Snack Bags" for take away school snacks or office lunch packs etc; "Small and Big Shoppers" help to arrange the transport of shopping from (super-) markets to the home food storage; the "Mega Shopper" is designed for professional and gastro-specific customer usage of the catering trades.

Content Measurement: Embossed unit markers on the backside use and provide scales of both, the Metric (ISO/IEC 80000) and the US Customary Measurement Systems.

Storage Date: Also on the backside, ISBs have an eternal calendar with embossed numbers to easily dry-mark storage dates.

Content Description: A blank field on ISBs' backsides may be used for legible and durable marking of content specific entries with adequate dry markers.

Tactile Alphabet: For enhanced customer convenience and to meet requirements of visually strongly impaired or blind persons, the disclosed bag provides the aforementioned information also in a tactile alphabet, using Braille Scripts on each backside of each ISB; also the color code is given in Braille.

Bag Design/Shape: During its curing process in a mold, the HTV-LSR elastomer gets its shape and form stability, while keeping flexibility and elasticity at the same time.

ISBs have a plain, rectangular bottom with two narrow side portions and two wider front- and back sides.

Wide at the bottom and narrow at the top end, ISB geometry is perfect for a) sitting safely at the table,
b) sitting firmly in a pot (bain-marie cooking), and
c) airtight closing.

Manipulation: Big handles allow safe manipulating and carrying of ISBs to and from microwave ovens and pots.

ISBs have two closing mechanisms, which have full functionality when either used separately or in combination:

a) is a nail-tab or coupling sleeve spot closing system, fixing ISB front and backside at two distinct spots at the bag top end, and
b) is a linear, male (cylinder-shaped)-female (canal shaped) system closing the bags upper cavity entirely.

The cylinder-canal coupling mechanism of a linear closing system provides excellent airtightness, which is desired for solid/liquid food storage scenarios. This cylinder shape closing was designed for easy closing for people with disabilities The spot closing system of nail and tab is good for heating up ISB content in microwave oven or bain-marie.

A latter closing mechanism is also helping the physically challenged persons and those, who suffer from manipulative disabilities or physical constraints, i.e. from Heberden's arthritis, etc.

Figure 3:
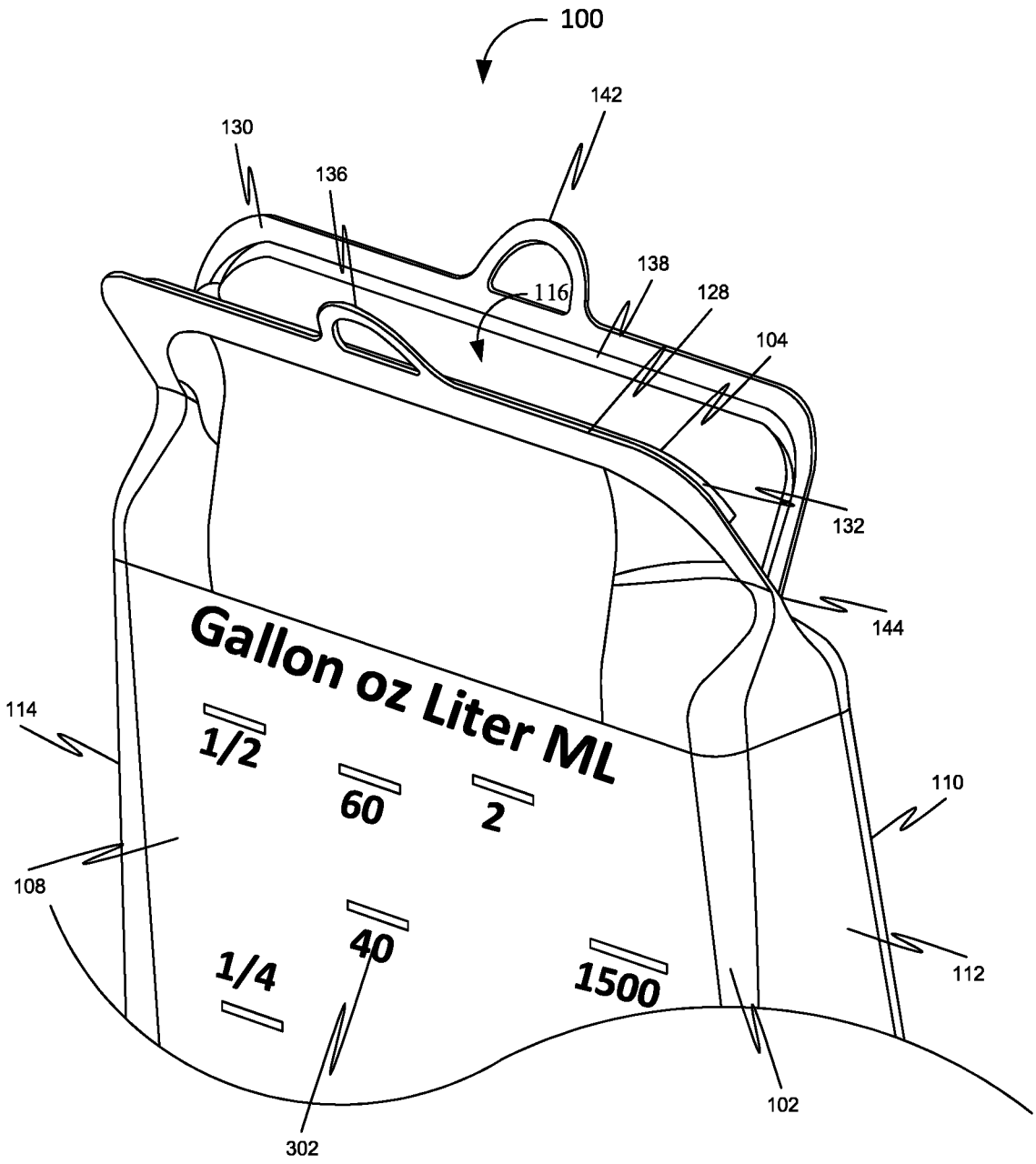
FIG. 3 is a partial front right-side perspective view of the bag with a multiple seal system, in accordance with some embodiments.

FIG. 1 is a rear right side perspective view of a bag 100 with a multiple seal system, in accordance with some embodiments. Accordingly, the bag 100 may include a container 102 and a seal 104. Further, the container 102 may include a bottom side 106, a first imprinted surface 108, a second imprinted surface 110, a plurality of side surfaces 112-114 and a cavity 116. Further, the first imprinted surface 108 may include a first imprinted media 302, as shown in FIG. 3. Further, the second imprinted surface 110 may include a second imprinted media 120.

Further, each side surface of the plurality of side surfaces 112-114 may be disposed between the first imprinted surface 108 and the second imprinted surface 110. Further, at least one of the first imprinted media 302 and the second imprinted media 120 may include an imprinted braille. Further, the bottom side 106 may include a plurality of vertexes 122-126. Further, the plurality of vertexes 122-126 connects the bottom side 106 to the first imprinted surface 108, the second imprinted surface 110, and the plurality of side surfaces 112-114 to form the cavity 116. Further, the cavity 116 may be configured for storing an item. Further, the cavity 116 may include a plurality of top edges (not shown).

Further, the seal 104 may be configured for preventing access to the cavity 116. Further, the seal 104 may include a male side 128 and a female side 130. Further, the male side 128 may be located on a first member (not shown) of the plurality of top edges. Further, the female side 130 may be located on a second member (not shown) of the plurality of top edges. Further, the male side 128 may include a ridge 132, a knob 134, and a first handle 136. Further, the ridge 132 may be positioned between the knob 134 and the first handle 136.

Further, the female side 130 may include a canal 138, a knob receiver 140, and a second handle 142. Further, the canal 138 may be positioned between the knob receiver 140 and the second handle 142. Further, the ridge 132 engages with the canal 138 to prevent access to the cavity 116. Further, the male side 128 and the female side 130 are detachably couplable.

Further, in some embodiments, the first imprinted media 302 of the first imprinted surface 108 may include an imprinted measurement system and the second imprinted media 120 of the second imprinted surface 110 may include a calendar. Further, the imprinted measurement system may be configured to measure quantity of the item stored in the container 102. Further, the calendar facilitates tracking of storage and expiration dates of the item stored in the container 102. Further, in some embodiments, the calendar may include a depressing mechanism. Further, the depressing mechanism may include a membrane (not shown) corresponding to each date of the calendar. Further, the membrane may include a deformable portion (not shown). Further, the membrane may be associated with two states. Further, a first state of the two states may include a deformed state. Further, a second state of the two states may include a raised state. Further, the membrane switches from the raised state to the deformed state based on action of a pressing force. Further, the membrane switches from the deformed state to the raised state based on action of a resetting force.

Figure 2:
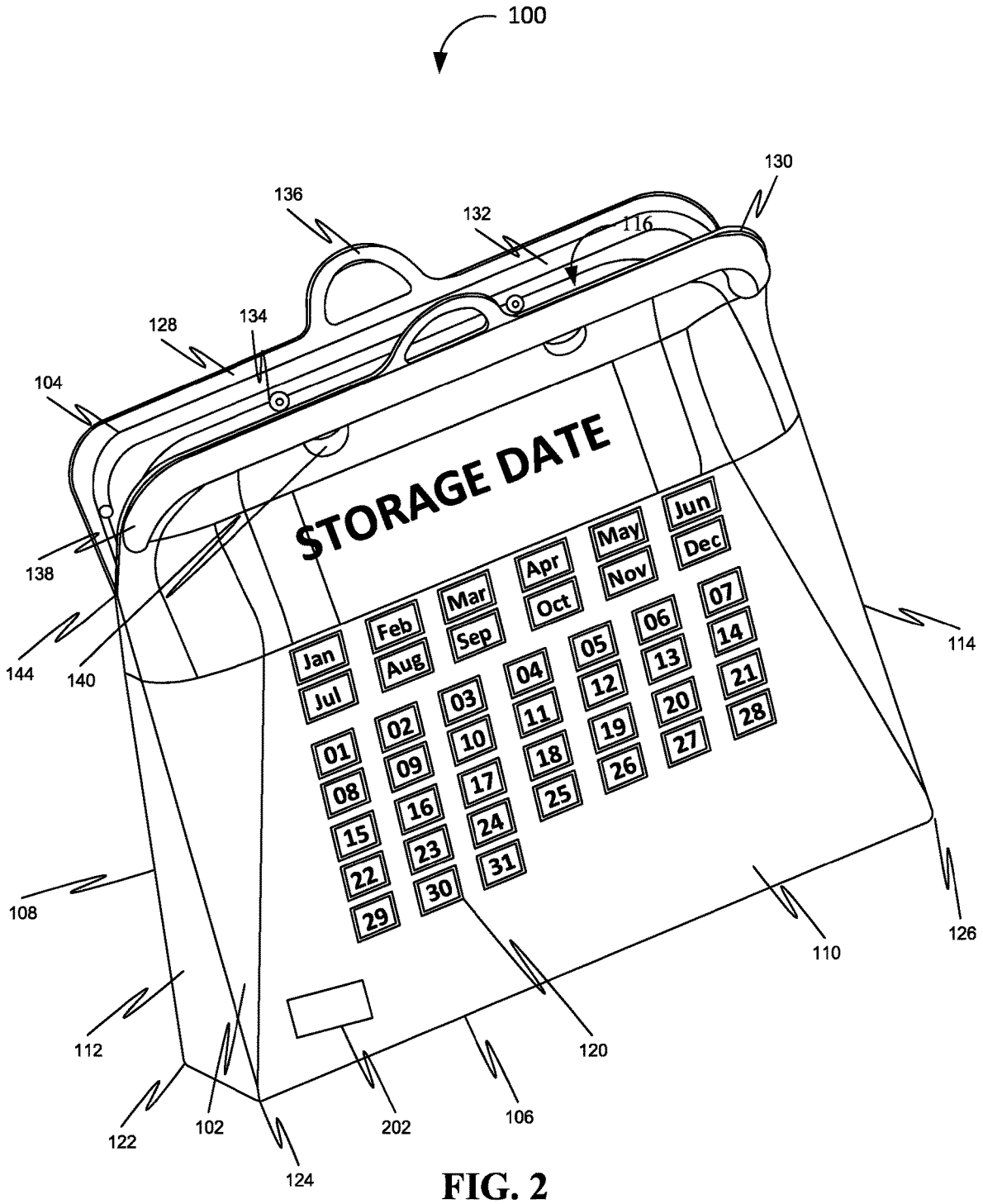
FIG. 2 is a rear right-side perspective view of the bag with a multiple seal system, in accordance with some embodiments.

Further, in some embodiments, the bag 100 further may include a temperature gauge strip 202, as shown in FIG. 2, disposed on the container 102. Further, the temperature gauge strip 202 may be configured for detecting and displaying temperature of the item stored in the container 102.

Further, in some embodiments, the each side surface of the plurality of side surfaces 112-114 may include a pinch point 144. Further, the pinch point 144 of the each side surface may be configured to provide rigidity to the container 102. Further, the rigidity of the container 102 facilitates maintenance of a container structure. Further, the container structure facilitates storage of the item in the cavity 116.

Further, in some embodiments, the container 102 may include a recyclable semi-rigid material. Further, the recyclable semi-rigid material may be configured for changing the container structure from a stable state to a transient state upon action of a deforming force. Further, the recyclable semi-rigid material may be configured for changing the container structure from the transient state to the stable state upon removal of the deforming force. Further, in some embodiments, the recyclable semi-rigid material may be configured for provisioning flexibility to the container structure. Further, the flexibility facilitates reversibility of the container 102.

Further, in some embodiments, the bag 100 may be configured for compaction.

Further, the compaction of the bag 100 facilitates storage of the bag 100.

Further, in some embodiments, the knob 134 may be associated with a first geometric shape and the canal 138 may be associated with a second geometric shape. Further, the first geometric shape and the second geometric shape may be configured for allowing maximum stiction to ensure airtightness. Further, the knob 134 and the knob receiver 140 may be detachably couplable.

Further, in some embodiments, the ridge 132 and the knob 134 may include a first material. Further, the canal 138 and the knob receiver 140 may include a second material.

Further, the first material may be harder than the second material. Further, the second material of the canal 138 and the knob receiver 140 may be configured for coupling with the first material of the ridge 132 and the knob 134. Further, in some embodiments, the canal 138 and the knob receiver 140 are configured to be coupled with the ridge 132 and the knob 134 using one hand by a user.

Further, in some embodiments, the bag 100 may be transparent.

Further, in some embodiments, the first handle 136 of the male side 128 couples with the second handle 142 of the female side 130 to form a combined handle for the seal 104.

Further, the first handle 136 and the second handle 142 are detachably couplable.

Further, in some embodiments, the bag 100 may be made from 100 percent food-grade silicone. Further, body of the bag 100 may be between 1 to 2 MM in thickness.

Further, in some embodiments, the bag 100 may have two lips that are a part of the body on the top part of the bag 100 that may help to close the bag 100.

Further, in some embodiments, a lip of the bag 100 may include two handles for holding the bag 100.

Further, in some embodiments, the ridge 132 (male tongue insert) may be a part of the lip that may be built into the lip in a mold. Further, the ridge 132 (male tongue insert) may be made from a harder silicone to hold its shape. Further, the shape of the ridge 132 (male tongue insert) may be a half-cylinder shape. Further, the ridge 132 (male tongue insert) may sit on the surface of the lip and the ridge 132 (male tongue insert) stretches from one corner of a bag lip to the other end of the bag 100. Further, the ridge 132 (male tongue insert) curves down on both sides of bag lips following the shape of the bag lips to the pinch point 144 of bag 100. Further, the ridge 132 (male tongue insert) when closing the bag 100 may be inserted into the opposite lip, where the canal 138 (female intake canal) takes in the ridge 132 (male tongue insert).

Further, in some embodiments, the canal 138 (female intake canal) may be a part of the lip that is carved into the lip in the mold the shape of the half-cylinder carved into the bag lip. Further, the canal 138 (female intake canal) curves down on both sides of the bag lips following the shape of the bag lips to the pinch point 144 of the bag 100. Further, the canal 138 (female intake canal) may be made from softer silicone to allow the ridge 132 (male insert tongue) to pass through the canal 138 easily. Further, the canal 138 (female intake canal) stretches from one corner of the bag lip to the other end of the bag lip. The purpose of the canal 138 (female intake canal) may be to receive the ridge 132 (male insert tongue) from the opposite lip for the closing of both lips together.

Further, in some embodiments, the knob 134 (male nipple) may be a small round raised silicone button type that sits on the lip on the same side as the ridge 132 (male insert tongue). The purpose of the knob 134 (male nipple) may be to assist in the closing of the lip. Further, the knob 134 (male nipple) gets inserted into the knob receiver 140 (nipple cavity intake) on the opposite lip. Depending on the size of the bag 100 there could be 4 to 6 male nipples on each lip.

Further, in some embodiments, the knob receiver 140 (nipple cavity intake) may be a small circular cavity that may be built on the lip of the bag 100 to receive the knob 134 (male nipple). Further, the knob 134 (male nipple) may be inserted into the knob receiver 140 (nipple cavity intake) for extra security for closing the bag 100. Depending on the size of the bag 100 there could be 4 to 6 Nipple cavity intakes.

Further, in some embodiments, the pinch point 144 may be the upper body part of the bag 100. Further, the pinch point 144 location may be directly under the lips, where the two sides of the bag 100 come together to the pinch point 144 to close the body of the bag 100. To close the pinch point 144, an FDA approved glue may be used to glue the two sides of the bag 100. Further, the pinch point 144 may be from half-inch to one inch in length. The rest of the bag's body is made from the mold.

Figure 4:
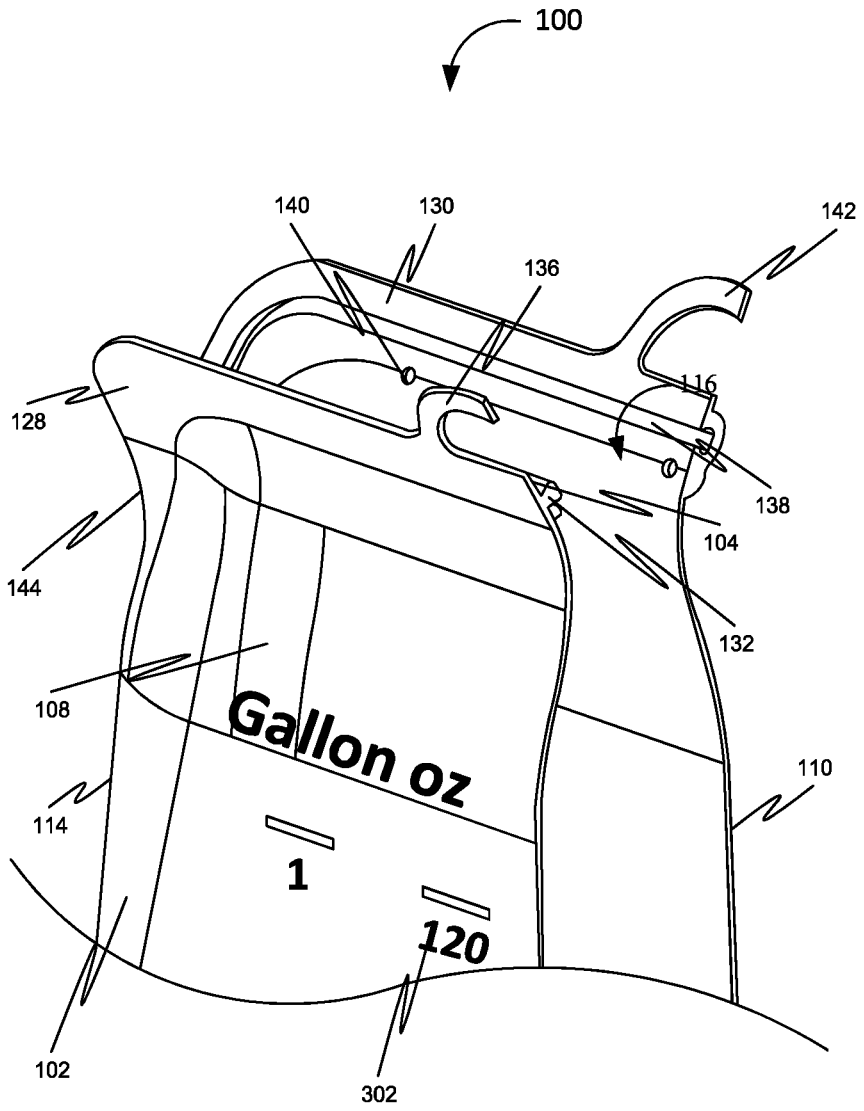
FIG. 4 is a partial front right-side perspective cut-out view of the bag with a multiple seal system, in accordance with some embodiments.
Figure 5:
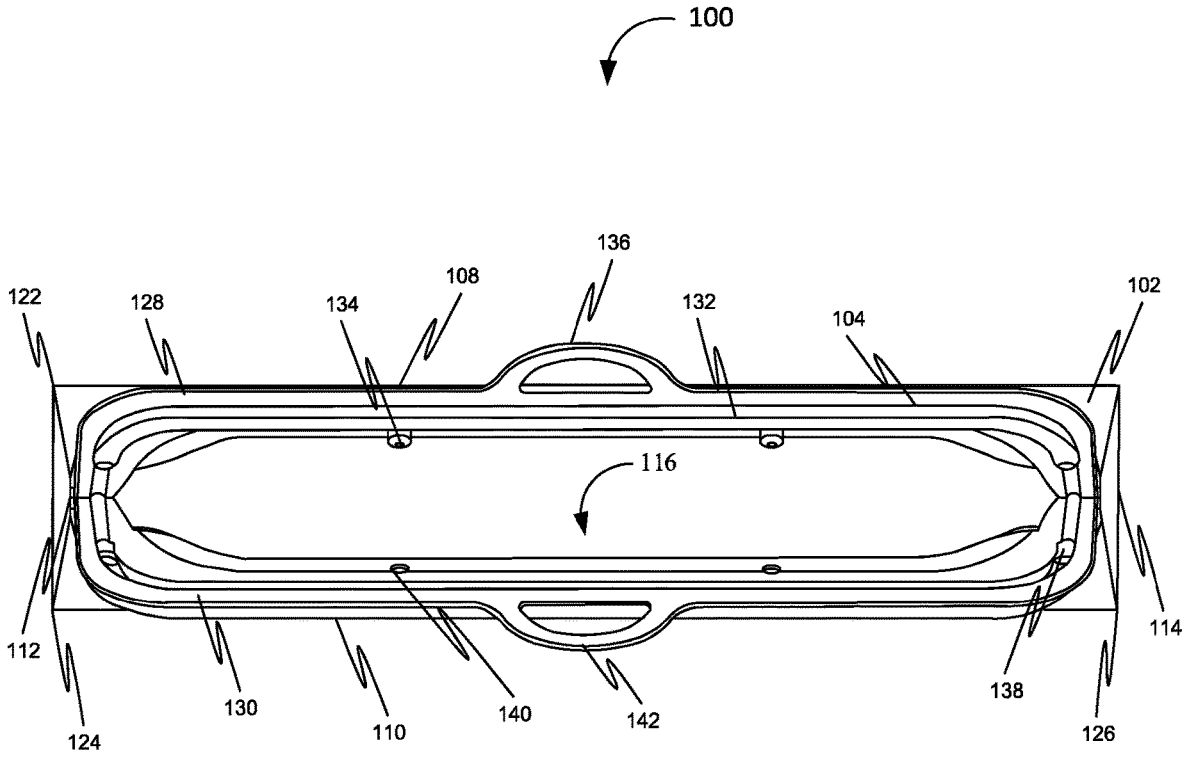
FIG. 5 is a top view of the bag with a multiple seal system, in accordance with some embodiments.
Figure 6:
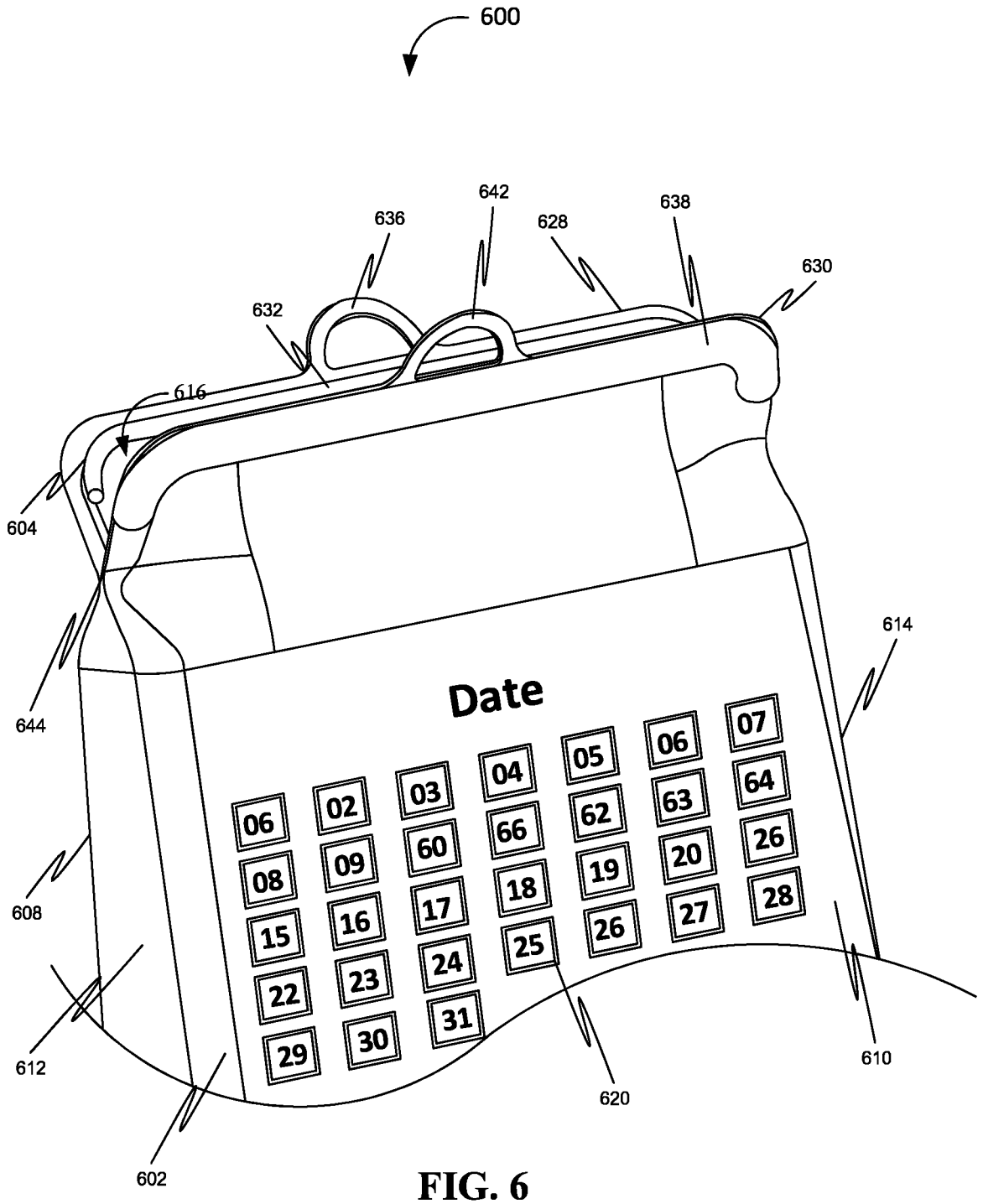
FIG. 6 is a partial rear right-side perspective view of a bag, in accordance with some embodiments.

Further, in some embodiments, the calendar (printed dates) may be printed on the bag 100. Further, the calendar (printed dates) may be made on the mold and every bag may have the calendar (printed dates) on them. Further, the calendar (printed dates) may be used for storing or freezing food in the refrigerator. Further, the user may use a dry eraser marker to mark the date you store the food in the freezer. Further, in some embodiments, the imprinted measurement system (printed measurements) may be part of the body of the bag 100. Further, volume measurements may be printed in each bag opposite side of the storage dates. Further, the volume measurements may give the user a better understanding of the volume the bag 100 may hold. Further, the measurement may read in gallons, ounces, and milliliters. FIG. 2 is a rear right-side perspective view of the bag 100 with a multiple seal system, in accordance with some embodiments. FIG. 3 is a partial front right-side perspective view of the bag 100 with a multiple seal system, in accordance with some embodiments. FIG. 4 is a partial front right-side perspective cut-out view of the bag 100 with a multiple seal system, in accordance with some embodiments. FIG. 5 is a top view of the bag 100 with a multiple seal system, in accordance with some embodiments. FIG. 6 is a partial rear right-side perspective view of a bag 600, in accordance with some embodiments. Accordingly, the bag 600 may include a container 602 and a seal 604. Further, the container 602 may include a first imprinted surface 608, a second imprinted surface 610, a plurality of side surfaces 612-614 and a cavity 616. Further, the first imprinted surface 608 may include a first imprinted media (not shown). Further, the second imprinted surface 610 may include a second imprinted media 620. Further, each side surface of the plurality of side surfaces 612-614 may be disposed between the first imprinted surface 608 and the second imprinted surface 610. Further, at least one of the first imprinted media and the second imprinted media 620 may include an imprinted braille. Further, the container 602 may include the cavity 616. Further, the cavity 616 may be configured for storing an item. Further, the cavity 616 may include a plurality of top edges (not shown).

Further, the seal 604 may be configured for preventing access to the cavity 616. Further, the seal 604 may include a male side 628 and a female side 630. Further, the male side 628 may be located on a first member (not shown) of the plurality of top edges. Further, the female side 630 may be located on a second member (not shown) of the plurality of top 10 edges. Further, the male side 628 may include a ridge 632 and a first handle 636. Further, the female side 630 may include a canal 638 and a second handle 642. Further, the ridge 632 engages with the canal 638 to prevent access to the cavity 616. Further, the male side 628 and the female side 630 are detachably couplable. Further, in some embodiments, the each side surface of the plurality of side surfaces 612-614 may include a pinch point 644.

Figure 7:
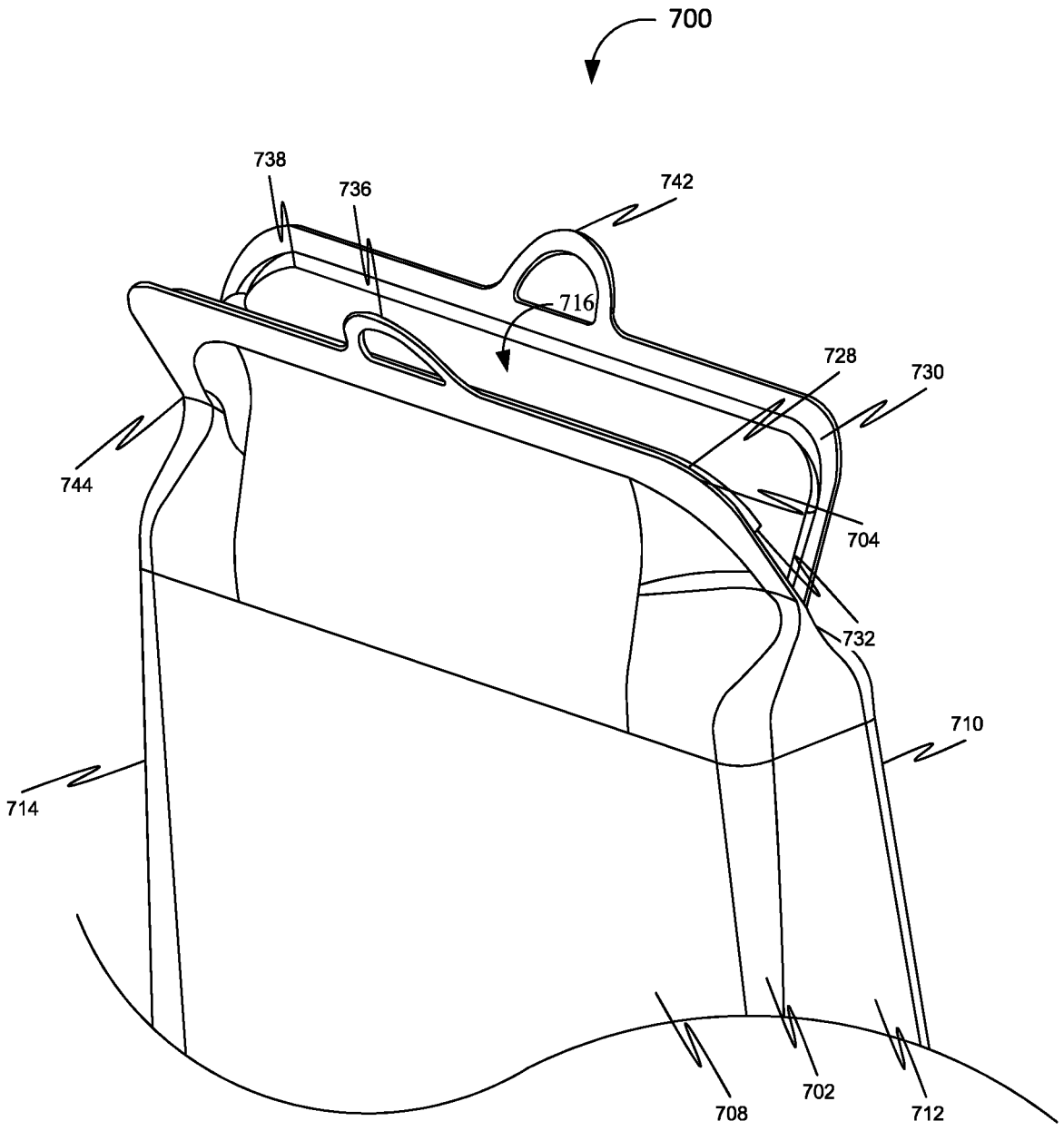
FIG. 7 is a partial front top perspective view of a bag, in accordance with some embodiments.

Further, the pinch point 644 of the each side surface may be configured to provide rigidity to the container 602. Further, the rigidity of the container 602 facilitates maintenance of a container structure. Further, the container structure facilitates storage of the item in the cavity 616. FIG. 7 is a partial front top perspective view of a bag 700, in accordance with some embodiments. Accordingly, the bag 700 may include a container 702 and a seal 704.

Further, the container 702 may include a first surface 708, a second surface 710, a plurality of side surfaces 712-714 and a cavity 716. Further, the first surface 708 may include a first imprinted media. Further, the second surface 710 may include a second imprinted media. Further, each side surface of the plurality of side surfaces 712-714 may be disposed between the first surface 708 and the second surface 710. Further, at least one of the first media and the second media may include an imprinted braille. Further, the container 702 may include the cavity 716. Further, the cavity 716 may be configured for storing an item. Further, the cavity 716 may include a plurality of top edges (not shown).

Further, the seal 704 may be configured for preventing access to the cavity 716. Further, the seal 704 may include a male side 728 and a female side 730. Further, the male side 728 may be located on a first member (not shown) of the plurality of top edges. Further, the female side 730 may be located on a second member (not shown) of the plurality of top edges. Further, the male side 728 may include a ridge 732 and a first handle 736. Further, the female side 730 may include a canal 738 and a second handle 742. Further, the ridge 732 engages with the canal 738 to prevent access to the cavity 716. Further, the male side 728 and the female side 730 are detachably couplable.

Figure 8:
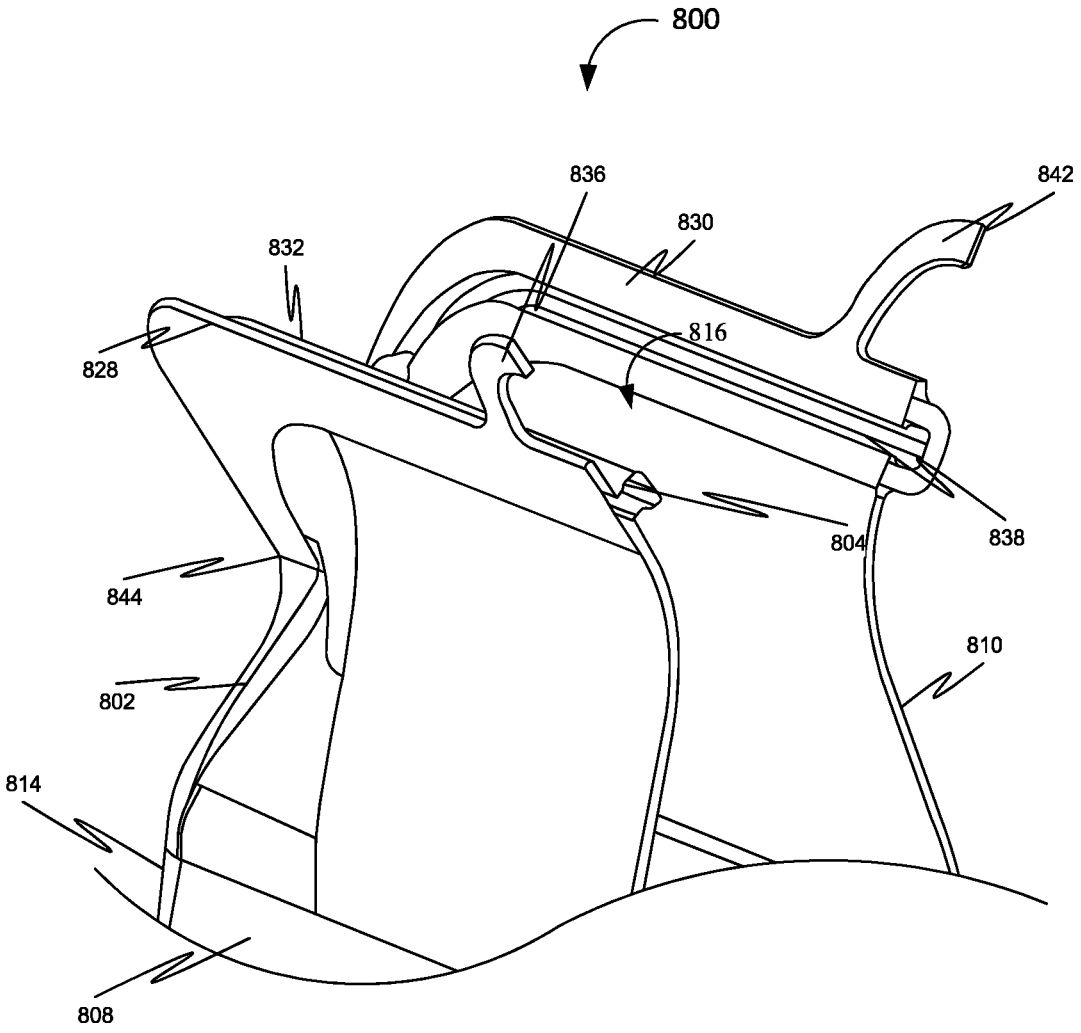
FIG. 8 is a partial front top perspective cut-out view of a bag, in accordance with some embodiments.

Further, in some embodiments, the each side surface of the plurality of side surfaces 712-714 may include a pinch point 744. Further, the pinch point 744 of the each side surface may be configured to provide rigidity to the container 702. Further, the rigidity of the container 702 facilitates maintenance of a container structure. Further, the container structure facilitates storage of the item in the cavity 716. FIG. 8 is a partial front top perspective cut-out view of a bag 800, in accordance with some embodiments. Accordingly, the bag 800 may include a container 802 and a seal 804. Further, the container 802 may include a first surface 808, a second surface 810, a side surfaces 814 and a cavity 816. Further, the first surface 808 may include a first imprinted media. Further, the second surface 810 may include a second imprinted media. Further, a side surface 814 of the container 802 may be disposed between the first surface 808 and the second surface 810. Further, at least one of the first media and the second media may include an imprinted braille. Further, the container 802 may include the cavity 816. Further, the cavity 816 may be configured for storing an item. Further, the cavity 816 may include a plurality of top edges (not shown).

Figure 9:
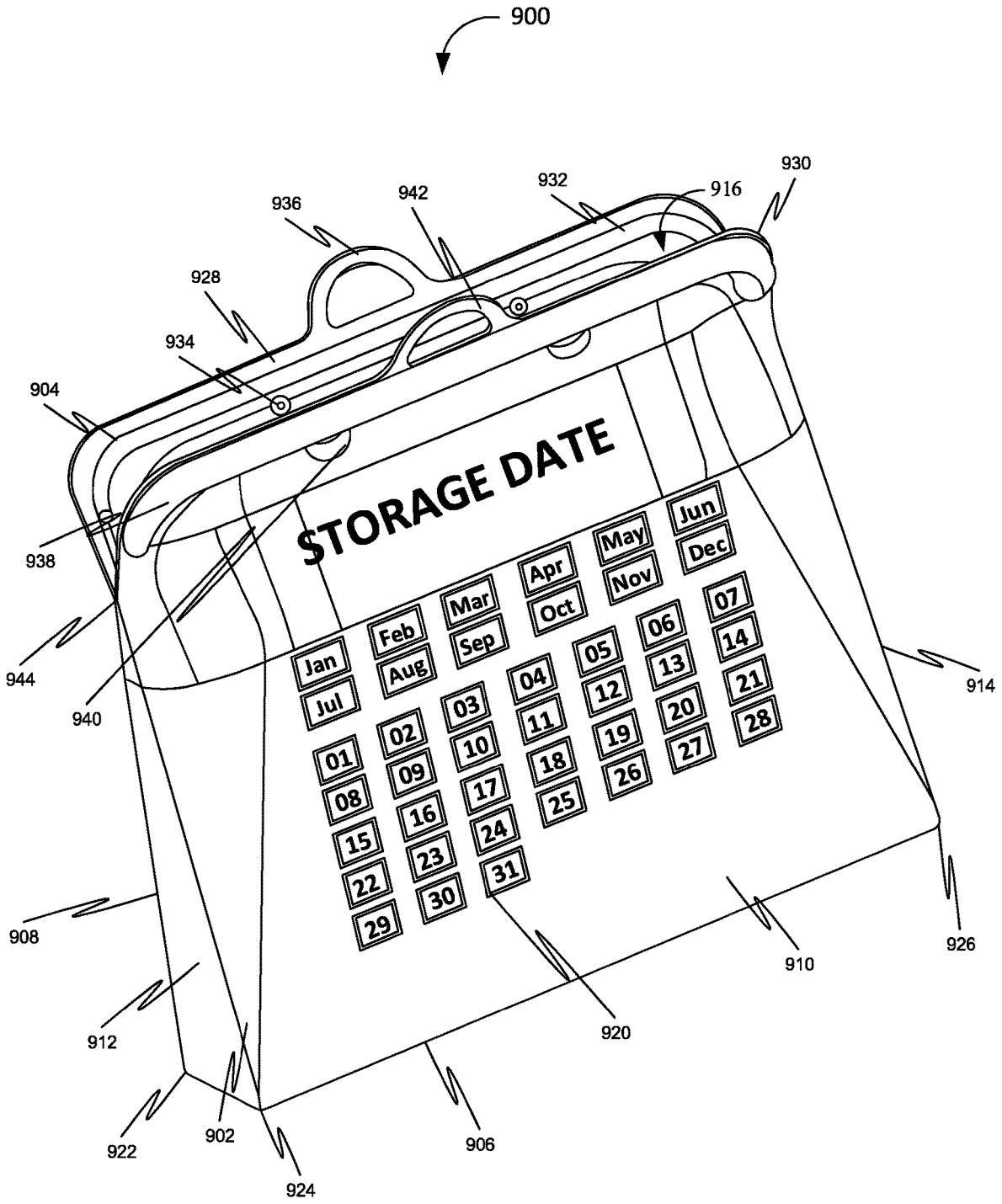
FIG. 9 is a rear right-side perspective view of a bag with a multiple seal system, in accordance with some embodiments.

Further, the seal 804 may be configured for preventing access to the cavity 816. Further, the seal 804 may include a male side 828 and a female side 830. Further, the male side 828 may be located on a first member (not shown) of the plurality of top edges. Further, the female side 830 may be located on a second member (not shown) of the plurality of top edges. Further, the male side 828 may include a ridge 832 and a first handle 836. Further, the female side 830 may include a canal 838 and a second handle 842. Further, the ridge 832 engages with the canal 838 to prevent access to the cavity 816. Further, the male side 828 and the female side 830 are detachably couplable. Further, in some embodiments, the side surface 814 may be associated with a pinch point 844. Further, the pinch point 844 may be configured to provide rigidity to the container 802. Further, the rigidity of the container 802 facilitates maintenance of a container structure. Further, the container structure facilitates storage of the item in the cavity 816. FIG. 9 is a rear right-side perspective view of a bag 900 with a multiple seal system, in accordance with some embodiments. Accordingly, the bag 900 may include a container 902 and a seal 904.

Figure 11:
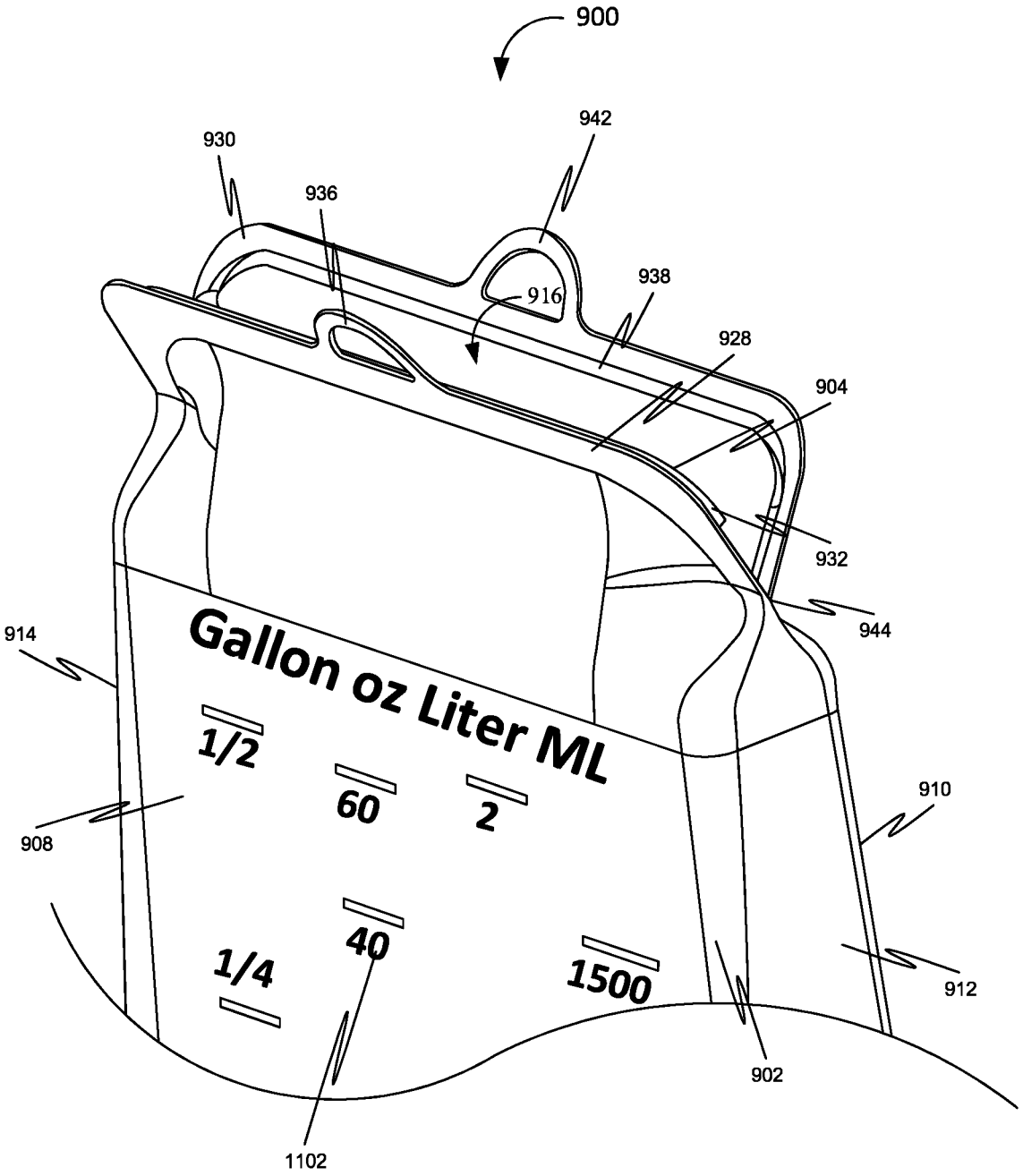
FIG. 11 is a partial front right-side perspective view of the bag with a multiple seal system, in accordance with some embodiments.

Further, the container 902 may include a bottom side 906, a first imprinted surface 908, a second imprinted surface 910, a plurality of side surfaces 912-914 and a cavity 916. Further, the first imprinted surface 908 may include a first imprinted media 1102, as shown in FIG. 11. Further, the second imprinted surface 910 may include a second imprinted media 920. Further, each side surface of the plurality of side surfaces 912-914 may be disposed between the first imprinted surface 908 and the second imprinted surface 910. Further, the first imprinted media 1102 of the first imprinted surface 908 may include an imprinted measurement system and the second imprinted media 920 of the second imprinted surfaces 910 may include a calendar. Further, the imprinted measurement system may be configured to measure quantity of an item stored in the container 902. Further, the calendar facilitates tracking of storage and expiration dates of the item stored in the container 902. Further, at least one of the first imprinted media 1102 and the second imprinted media 920 may include an imprinted braille (not shown). Further, the bottom side 906 may include a plurality of vertexes 922-926. Further, the plurality of vertexes 922-926 connects the bottom side 906 to the first imprinted surface 908, the second imprinted surface 910, and the plurality of side surfaces 912-914 to form the cavity 916. Further, the cavity 916 may be configured for storing the item. Further, the cavity 916 may include a plurality of top edges (not shown).

Further, the seal 904 may be configured for preventing access to the cavity 916. Further, the seal 904 may include a male side 928 and a female side 930. Further, the male side 928 may be located on a first member (not shown) of the plurality of top edges. Further, the female side 930 may be located on a second member (not shown) of the plurality of top edges. Further, the male side 928 may include a ridge 932, a knob 934, and a first handle 936. Further, the ridge 932 may be positioned between the knob 934 and the first handle 936. Further, the female side 930 may include a canal 938, a knob receiver 940, and a second handle 942. Further, the canal 938 may be positioned between the knob receiver 940 and the second handle 942. Further, the ridge 932 engages with the canal 938 to prevent access to the cavity 916. Further, the male side 928 and the female side 930 are detachably couplable.

Figure 10:
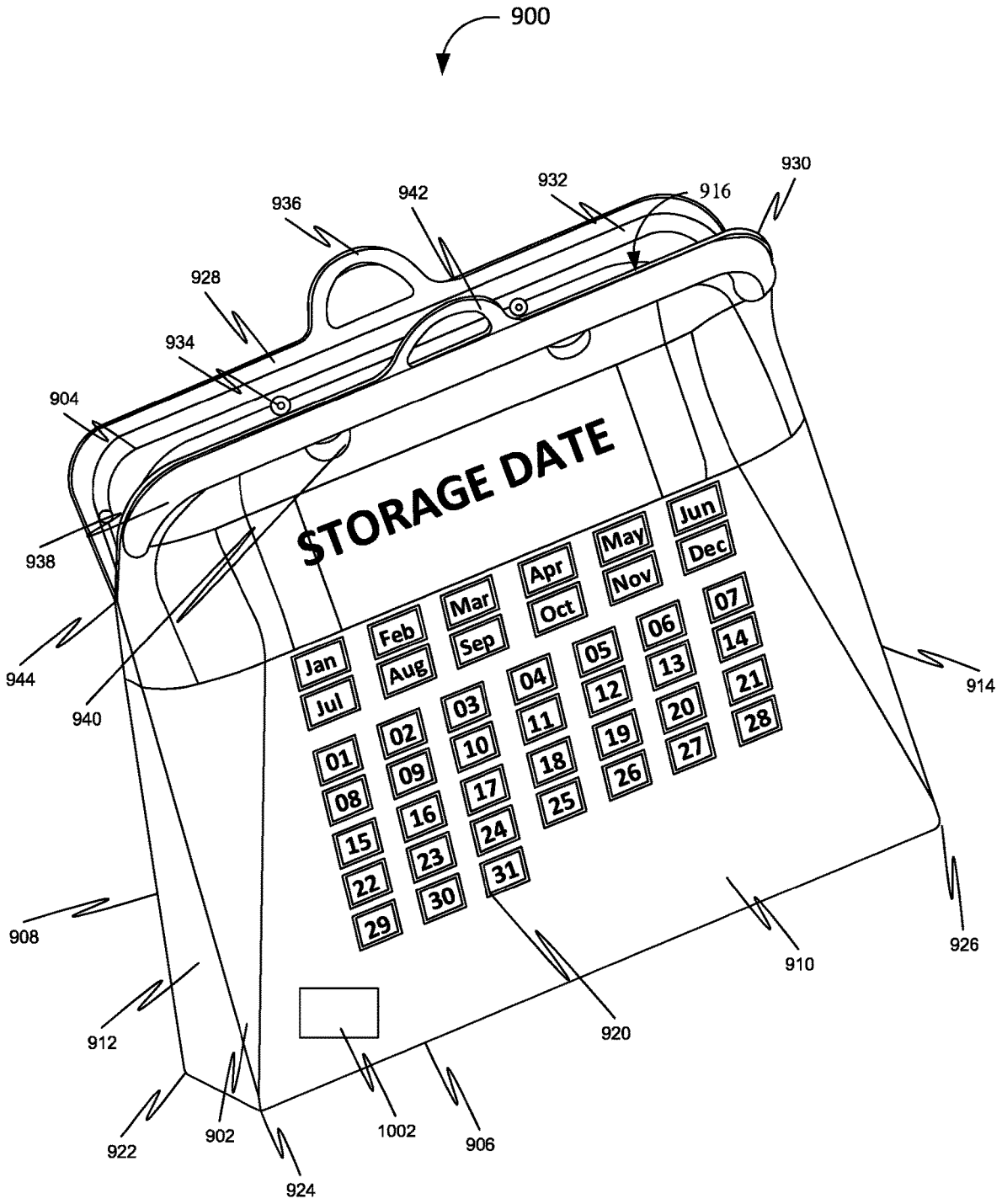
FIG. 10 is a rear right-side perspective view of the bag with a multiple seal system, in accordance with some embodiments.

Further, in some embodiments, the calendar may include a depressing mechanism. Further, the depressing mechanism may include a membrane (not shown) corresponding to each date of the calendar. Further, the membrane may include a deformable portion. Further, the membrane may be associated with two states. Further, a first state of the two states may include a deformed state. Further, a second state of the two states may include a raised state. Further, the membrane switches from the raised state to the deformed state based on action of a pressing force. Further, the membrane switches from the deformed state to the raised state based on action of a resetting force. Further, in some embodiments, the bag 900 further may include a temperature gauge strip 1002, as shown in FIG. 10, disposed on the container 902. Further, the temperature gauge strip 1002 may be configured for detecting and displaying temperature of the item stored in the container 902. Further, in some embodiments, the each side surface of the plurality of side surfaces 912-914 may include a pinch point 944. Further, the pinch point 944 of the each side surface may be configured to provide rigidity to the container 902. Further, the rigidity of the container 902 facilitates maintenance of a container structure. Further, the container structure facilitates storage of the item in the cavity 916.

Figure 12:
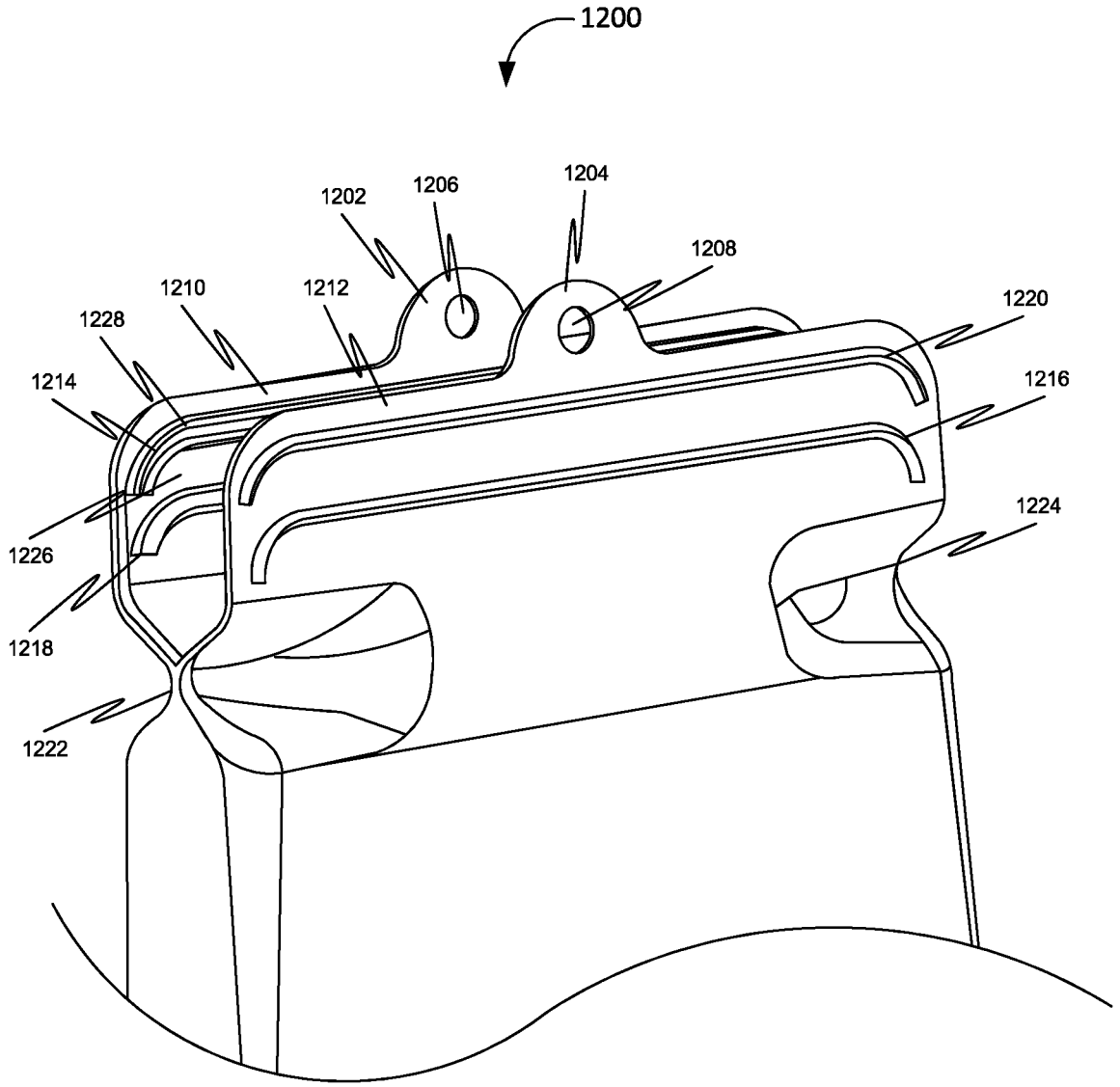
FIG. 12 is a partial front top perspective view of a bag with a multiple seal, in accordance with some embodiments.
Figure 13:
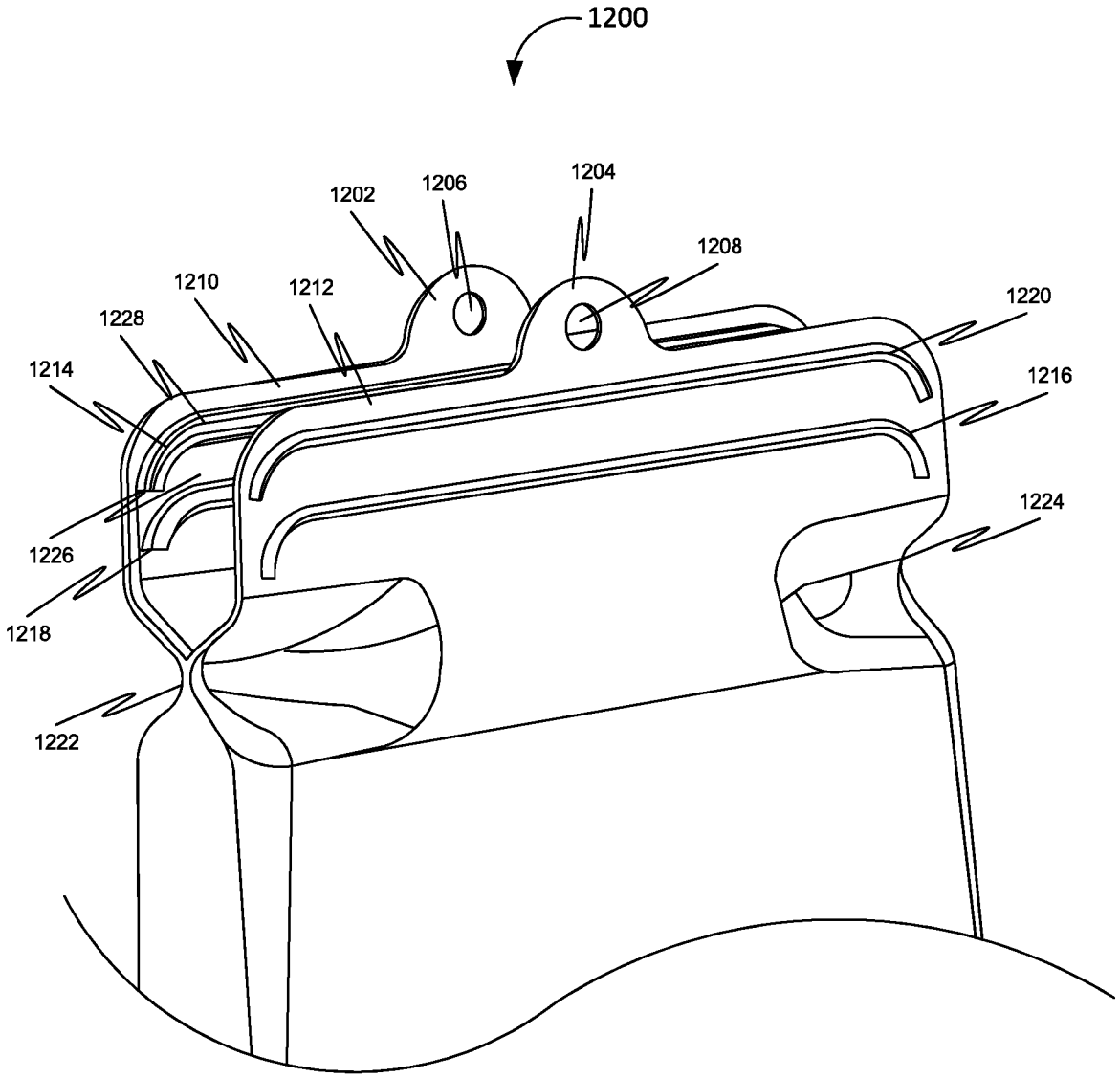
FIG. 13 is a partial front top perspective view of the bag with the multiple seal, in accordance with some embodiments.
Figure 14:
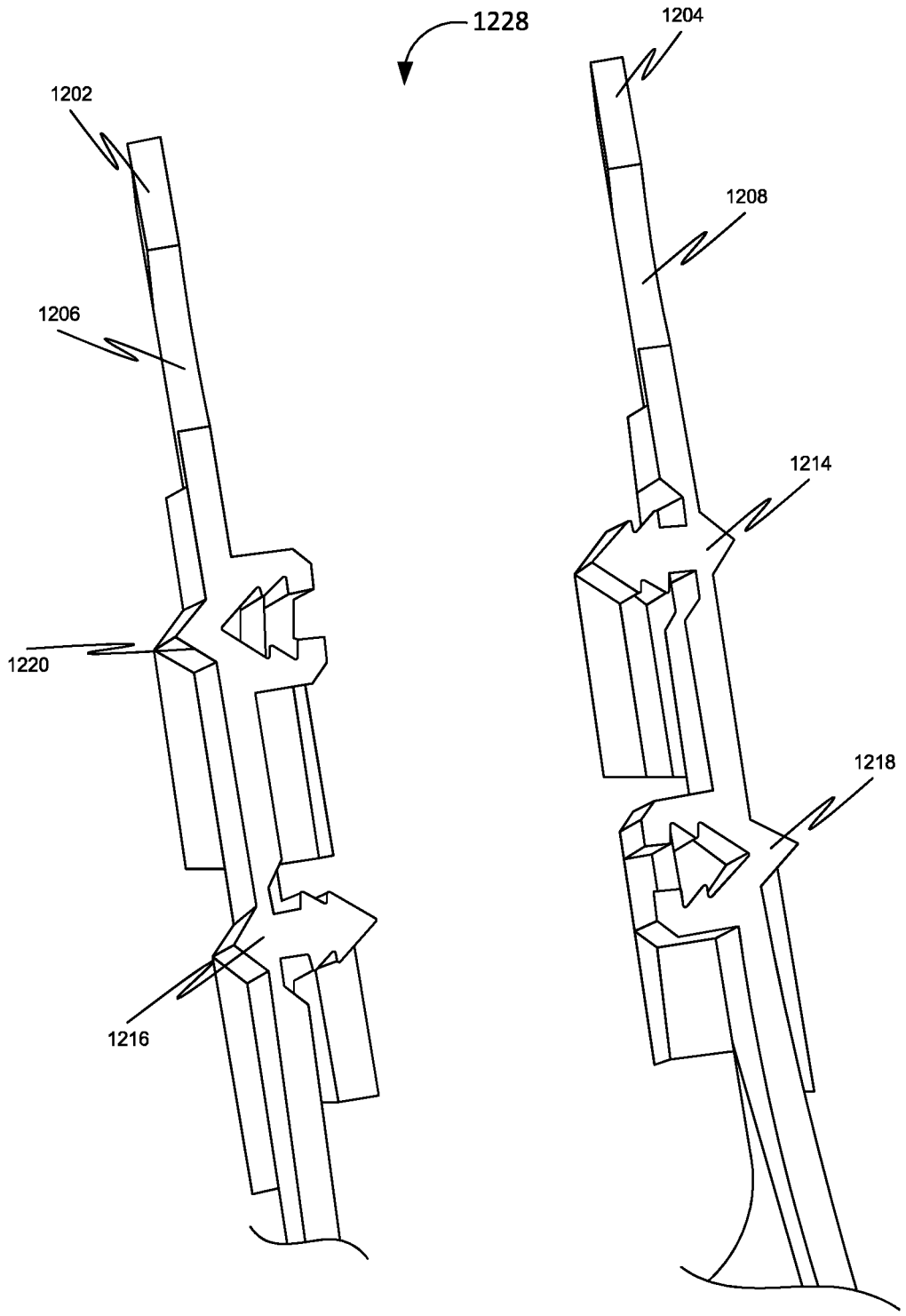
FIG. 14 is a partial right-side perspective view of the multiple seal associated with the bag, in accordance with some embodiments.

Further, in some embodiments, the container 902 may include a recyclable semi-rigid material. Further, the recyclable semi-rigid material may be configured for changing the container structure from a stable state to a transient state upon action of a deforming force. wherein the recyclable semi-rigid material may be configured for changing the container structure from the transient state to the stable state upon removal of the deforming force. Further, in some embodiments, the bag 900 may be configured for compaction. Further, the compaction of the bag 900 facilitates storage of the bag 900. Further, in some embodiments, the knob 934 may be associated with a first geometric shape and the canal 938 may be associated with a second geometric shape. Further, the first geometric shape and the second geometric shape may be configured for allowing maximum stiction to ensure airtightness. Further, the knob 934 and the knob receiver 940 may be detachably couplable. FIG. 10 is a rear right-side perspective view of the bag 900 with a multiple seal system, in accordance with some embodiments. FIG. 11 is a partial front right-side perspective view of the bag 900 with a multiple seal system, in accordance with some embodiments. FIG. 12 is a partial front top perspective view of a bag 1200 with a multiple seal 1228, in accordance with some embodiments. Further, the bag 1200 may include first bag handle 1202, second bag handle 1204, a first handle hole 1206, a second handle hole 1208, a first bag lip 1210, a second bag lip 1212, a left pinch point 1222, a right pinch point 1224, and a leak trap space 1226. Further, the multiple seal 1228 may include a first male tongue insert 1214, a second male tongue insert 1216, a first female intake canal 1218, and a second female intake canal 1220. Further, the bag 1200 may include a variation of the closing of bag lips mechanism. In this variation, the entire bag body is the same as the original bag (Gallon size bag). In this embodiment, a double male tongue may be inserted on the bag lips as well as the double female intake canal may be inserted on the bag lips. Further, the first male insert tongue 1214 and the first female intake canal 1218 may be added on one side of the lip such that the first male tongue insert 1214 on top and the first female intake canal 1218 on the bottom same lip. On the opposite side of the lip, with the second female intake canal 1220 on top and the second male tongue insert 1216 on the bottom. This variation can double the airtightness of a seal. In this variation, a male nipple from the lip, as well as a nipple cavity, may be removed from the bag 1200. FIG. 13 is a partial front top perspective view of the bag 1200 with the multiple seal 1228, in accordance with some embodiments. In this embodiment, the bag body stays the same as our original bag. Further, the bag 1200 may include a double male tongue insert and a double female intake canal, as shown in FIG. 12, there is the first male tongue insert 1214 and the first female intake canal 1218 on one lip and the process repeats itself over to the opposite lip. The major change is to the shape associated with the first male tongue insert 1214, second male tongue insert 1216, the first female intake canal 1218, and the second female intake canal 1220. In this variation, an innovative silicone storage bag, the shape of the first male tongue insert 1214 and the second male tongue insert 1216 may be a double arrow head type, as shown in FIG. 14. The arrow heads are made from harder silicone to easily penetrate the softer silicone of the first female intake canal 1218 and the second female intake canal 1220. Further, the first female intake canal 1218 and the second female intake canal 1220 may be designed with softer silicone to intake the double arrow head male tongue inserts. The shape of the female intake canals may allow the male insert tongue inserts to easily pass through it while the small flaps inside the canal preventing the male tongue inserts from popping out. This design allows the arrow head to pass through and lock in place once it reaches its final cavity wall. There is also a dead space between the male tongue inserts and the female intake canals this space is called the leak trap space 1226. The function of this space is to hold any extra liquid that has passed through the first set of the male tongue inserts and the female intake canals. FIG. 14 is a partial right-side perspective view of the multiple seal 1228 associated with the bag 1200, in accordance with some embodiments.

Figure 15:
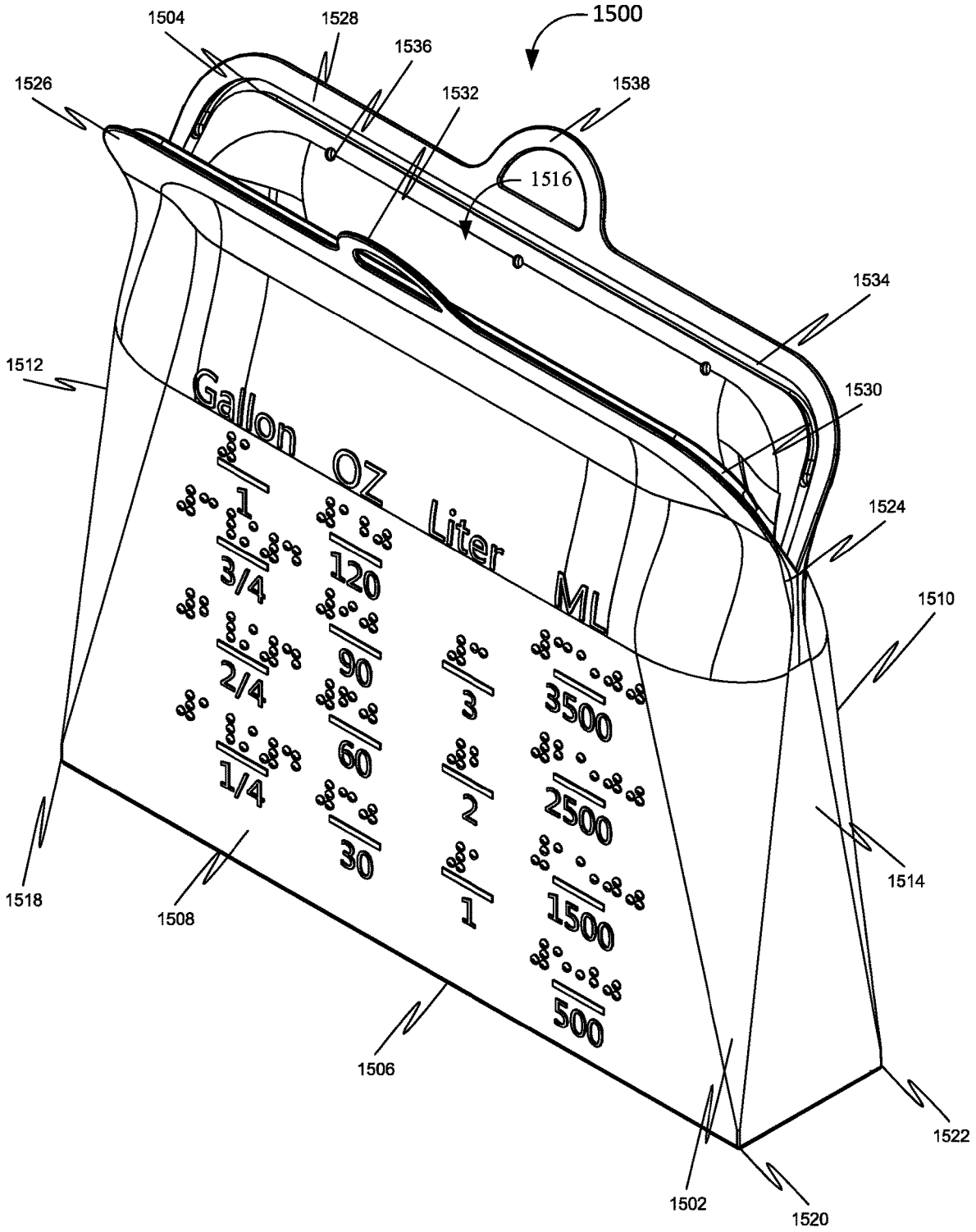
FIG. 15 is a front right-side perspective view of a bag, in accordance with some embodiments.

FIG. 15 is a front right-side perspective view of a bag 1500, in accordance with some embodiments. Further, the bag 1500 may be sealed by an individual with disabilities and further sealed by an individual without disabilities. Further, the bag 1500 may include a container 1502 and a seal 1504. Further, the container 1502 may be made of food-grade silicone. This allows the container 1502 to be reused. Further, in some embodiments, the container 1502 may also be made of other reusable materials.

Further, the container 1502 may include a bottom side 1506, a first imprinted surface 1508, a second imprinted surface 1510, a plurality of side surfaces 1512-1514 and a cavity 1516. Further, the bottom side 1506 may include a plurality of vertexes 1518-1522. Further, the plurality of vertexes 1518-1522 provides the container 1502 with some rigidity. Further, the plurality of vertexes 1518-1522 connects the bottom side 1506 to the first imprinted surface 1508, the second imprinted surface 1510, and the plurality of side surfaces 1512-1514. Further, the first imprinted surface 1508 may include imprinted media and the second imprinted surface may include imprinted media. Further, in some embodiments, the imprinted media of the first imprinted surface 1508 is an imprinted measurement system and the imprinted media of the second imprinted surfaces is a calendar. Further, the imprinted measurement system provides a function by measuring how much of the container 1502 is filled up. Further, the calendar provides a function by keeping track of storage and expiration dates of the items stored in the container 1502. Further, the measurement system has an imprinted braille (not shown). Further, in some embodiments, the first imprinted surface 1508 and the second imprinted surface 1510 both may have different imprinted media.

Further, each individual member of the plurality of side surfaces 1512-1514 is located in between the first imprinted surface 1508 and the second imprinted surface. Each individual member of the plurality of side surfaces 1512-1514 may include a pinch point 1524. Further, the pinch point 1524 of each individual member of the plurality of side surfaces 1512-1514 provides the container 1502 with some rigidity. Further, the rigidity provided by the pinch point 1524 of each member of the side surfaces combined with the rigidity provided by the plurality of vertexes 1518-1522 ensures the container 1502 partially maintains its structure regardless of the container 1502 being empty or not. Further, the cavity 1516 allows for items to be stored in the container 1502. Further, the cavity 1516 may include a plurality of top edges (not shown). Further, the plurality of top edges provides a location for the seal 1504.

Figure 21:
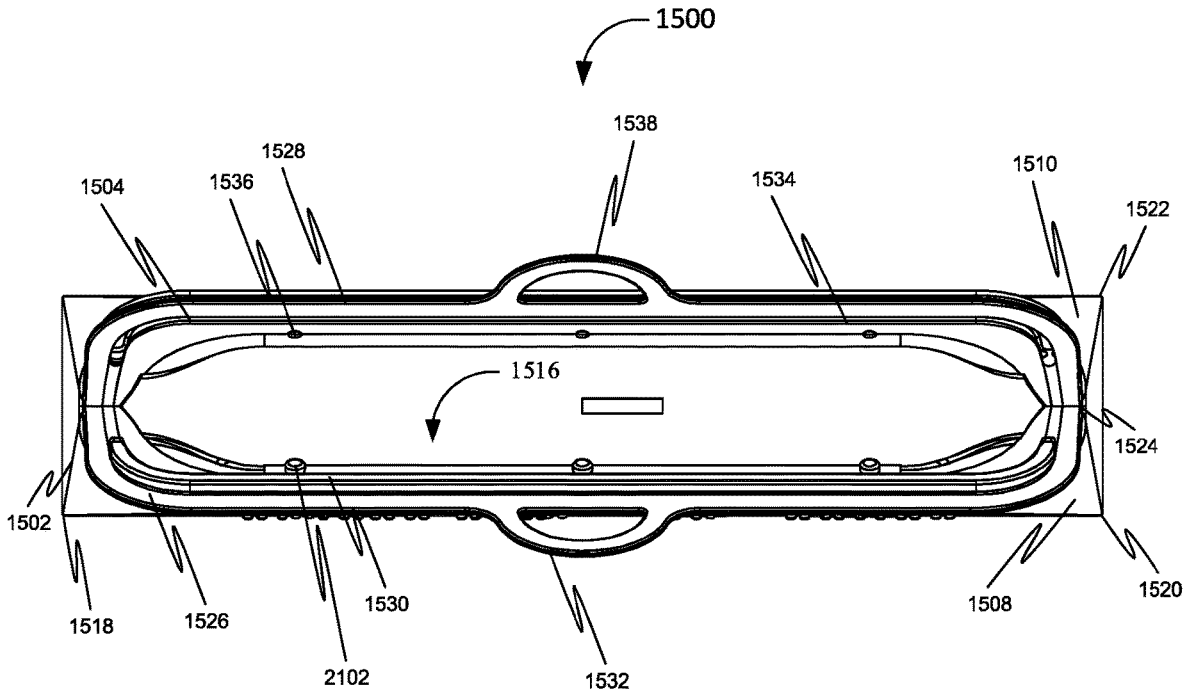
FIG. 21 is a top view of the bag, in accordance with some embodiments.

Further, the seal 1504 can prevent access to the cavity 1516. Further, the seal 1504 may include a male side 1526 and a female side 1528. Further, the male side 1526 is located on a member of the plurality of top edges while the female side 1528 is located on a different member of the plurality of top edges. Further, the male side 1526 may include a ridge 1530, a knob 2102, as shown in FIG. 21, and a first handle 1532. Further, the ridge 1530 is positioned between the knob 2102 and the first handle 1532. Further, the female side 1528 may include a canal 1534, a knob receiver 1536, and a second handle 1538. Further, the canal 1534 is positioned between the knob receiver 1536 and the second handle 1538. Further, the ridge 1530 can engage with the canal 1534 to prevent access to the cavity 1516. Further, the ridge 1530 and the knob 2102 are made from material harder than the material the canal 1534 and knob receiver 1536 are made of. Further, the ridge 1530 and the canal 1534 may allow an individual with disabilities to engage the ridge 1530 with the canal 1534 to prevent access to the cavity 1516. The geometric shape of the knob 2102 and the knob receiver 1536 allow for maximum stiction to ensure airtightness. Further, the knob 2102 and the knob receiver 1536 can be engaged by an individual without disabilities to further prevent access to the cavity 1516. Further, the first handle 1532 of the male side 1526 can engage with the second handle 1538 of the female side 1528 to form a handle for the seal 1504.

Figure 16:
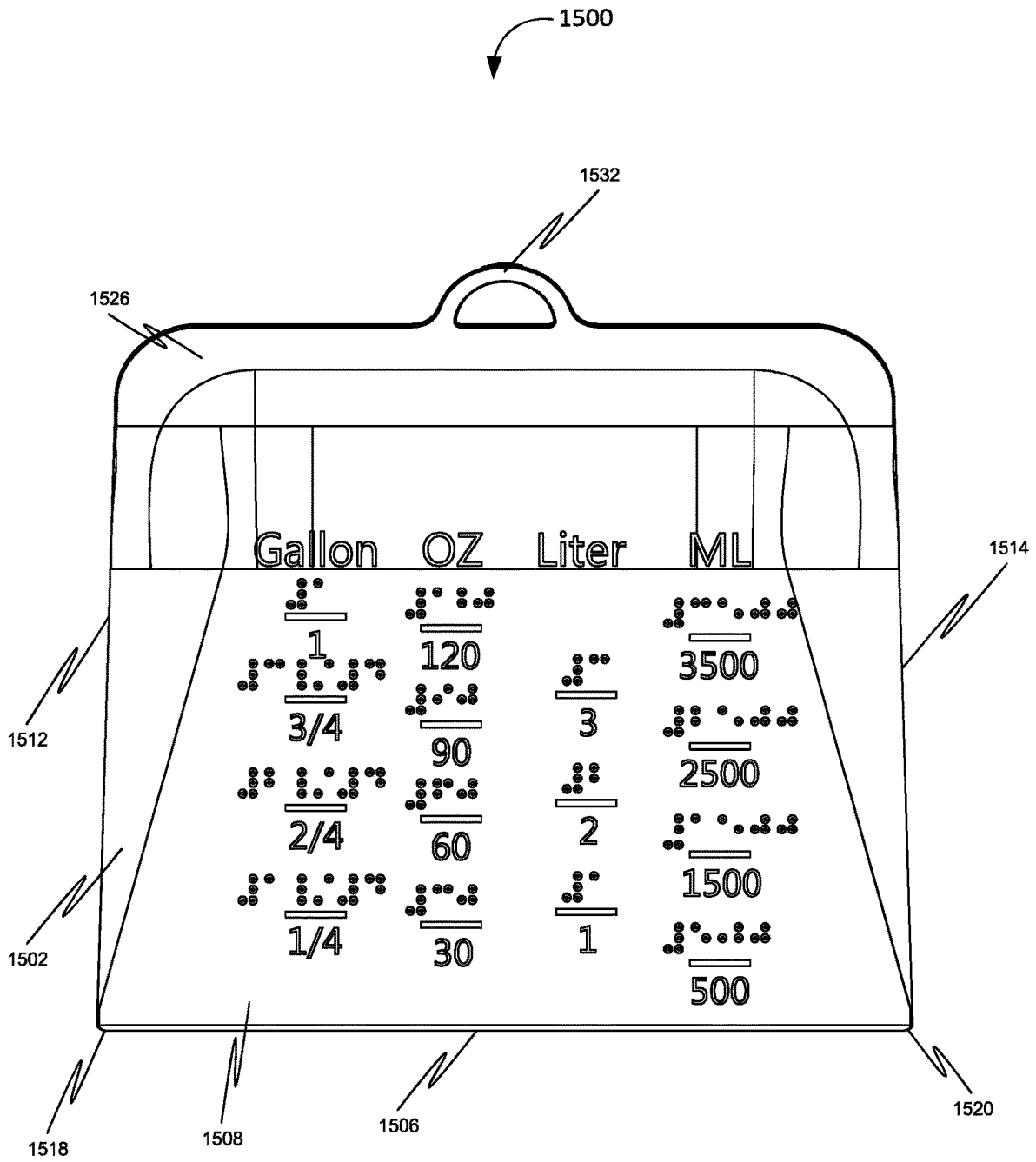
FIG. 16 is a front view of the bag, in accordance with some embodiments.
Figure 17:
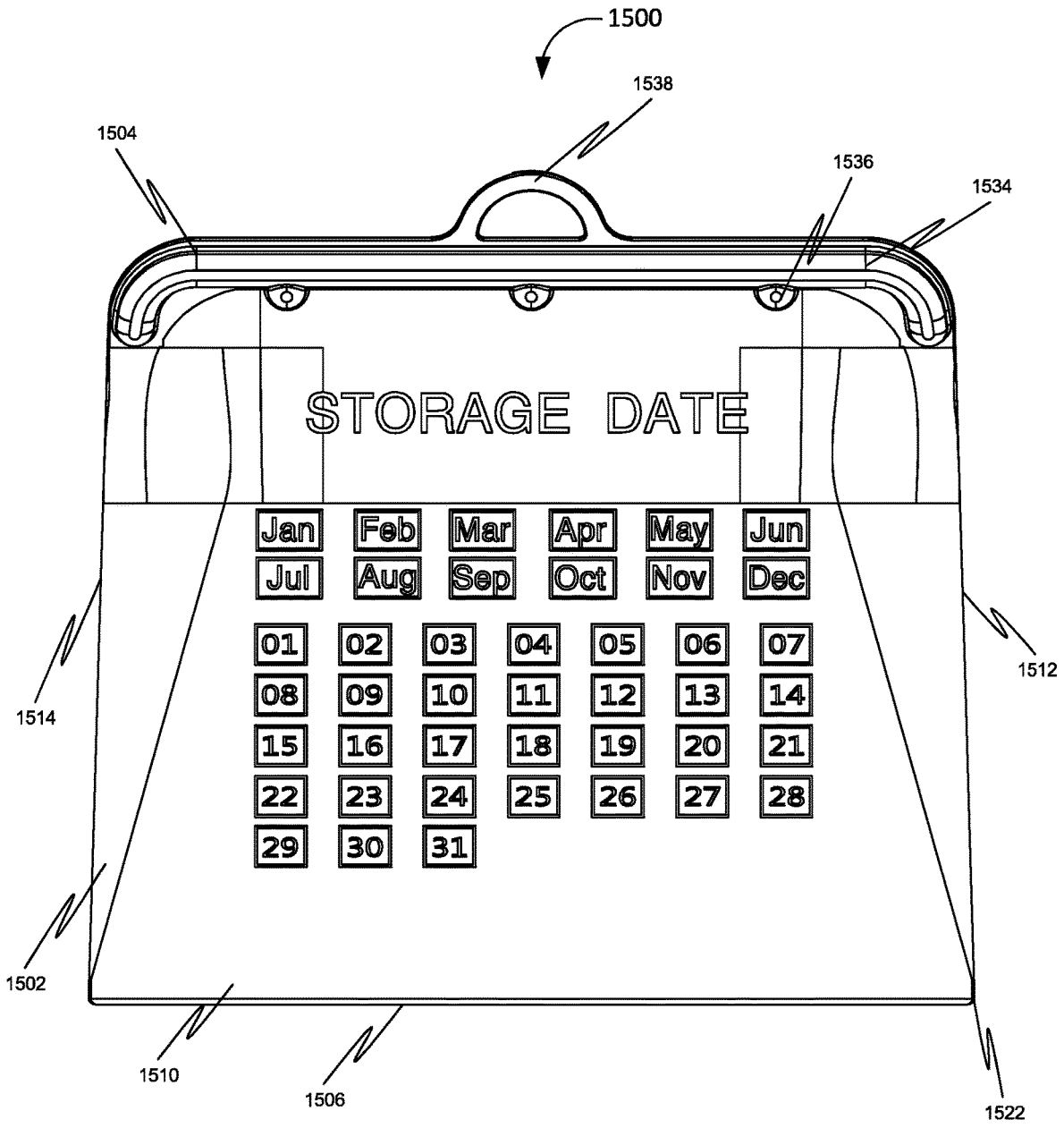
FIG. 17 is a rear view of the bag, in accordance with some embodiments.
Figure 18:
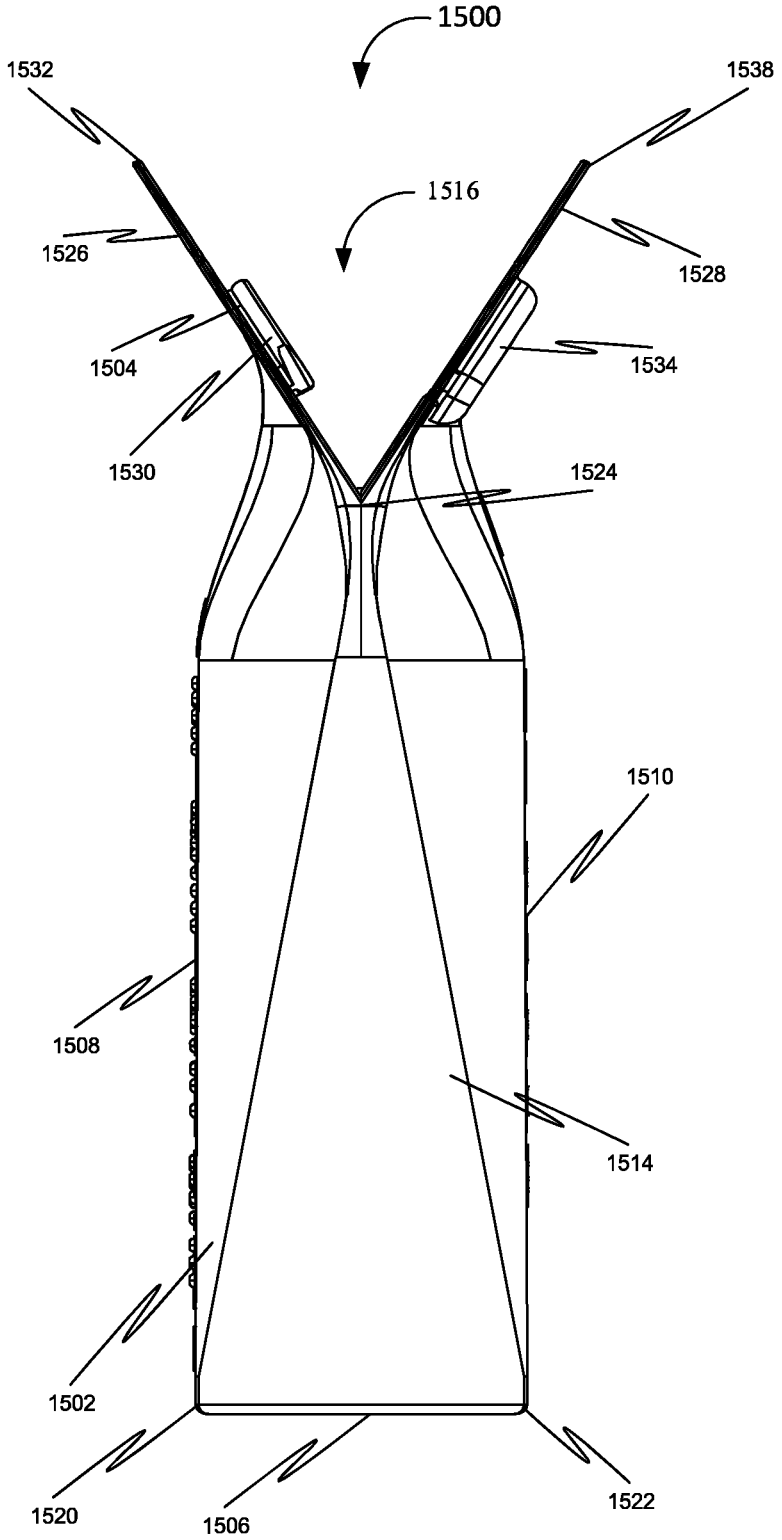
FIG. 18 is a right-side view of the bag, in accordance with some embodiments.
Figure 19:
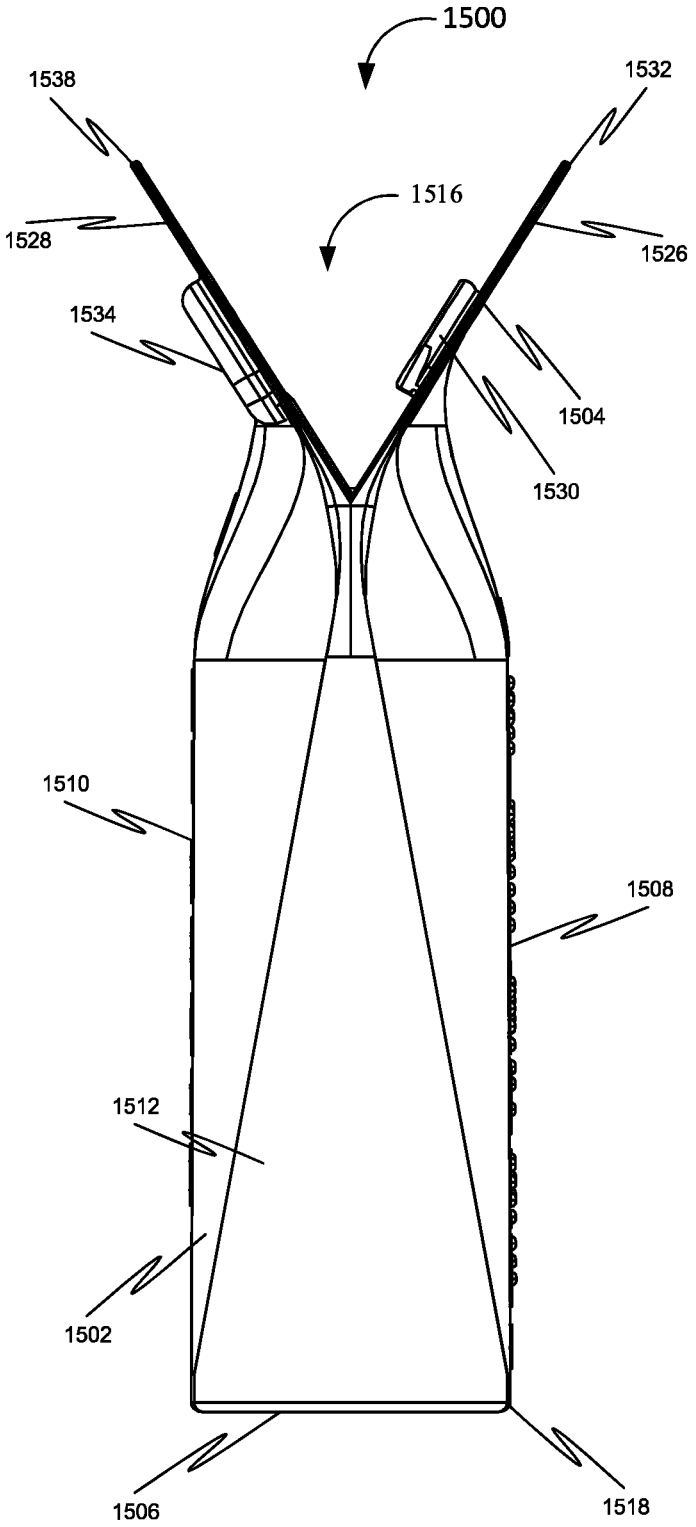
FIG. 19 is a left-side view of the bag, in accordance with some embodiments.
Figure 20:
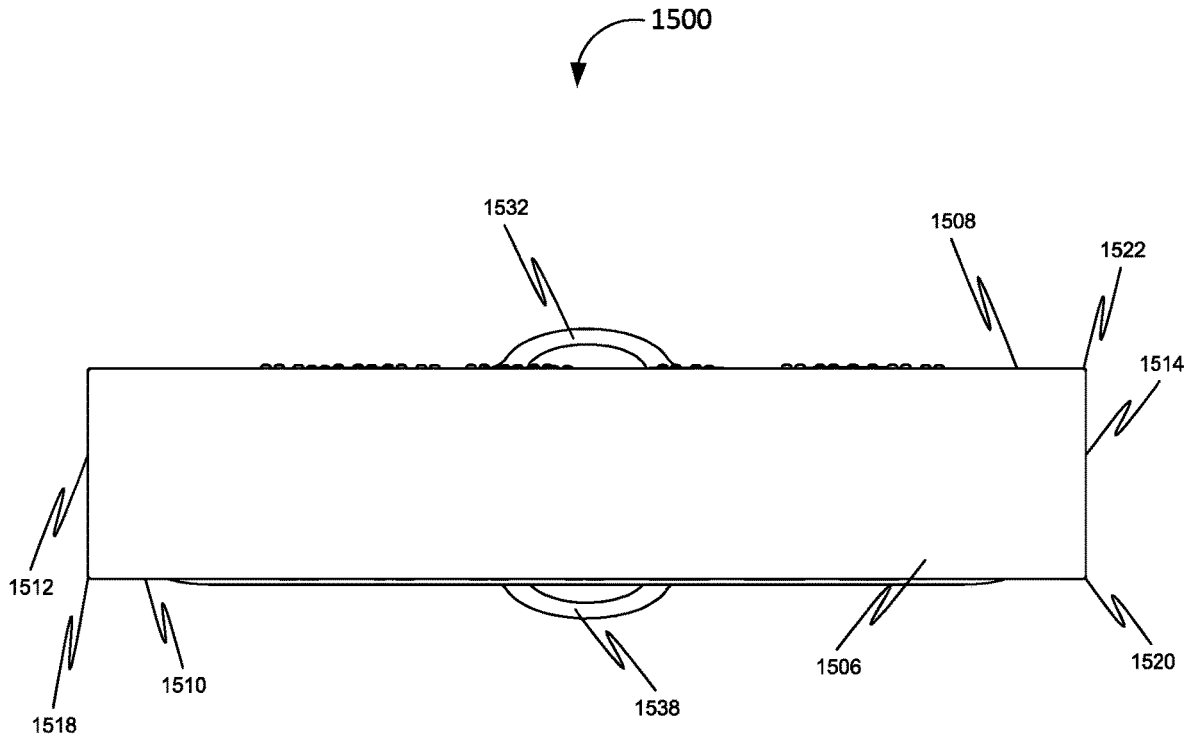
FIG. 20 is a bottom view of the bag, in accordance with some embodiments.

FIG. 16 is a front view of the bag 1500, in accordance with some embodiments. FIG. 17 is a rear view of the bag 1500, in accordance with some embodiments. FIG. 18 is a right-side view of the bag 1500, in accordance with some embodiments. FIG. 19 is a left-side view of the bag 1500, in accordance with some embodiments. FIG. 20 is a bottom view of the bag 1500, in accordance with some embodiments. FIG. 21 is a top view of the bag 1500, in accordance with some embodiments.

The device of the instant invention cannot be folded. It is configured such that the side surfaces remain intact and rigid even though the bag can be turned inside out such that the surfaces with indicia are no longer on the outside. Each side surface is an integrally smooth surface without areas that are capable of folding the bag, i.e., the bag cavity cannot be removed through the folding of the bag. The plurality of side surfaces are integrally smooth surfaces without areas that are capable of folding the bag and therefore the cavity cannot be removed through the folding of the bag.

Although the present disclosure has been explained in relation to its preferred embodiment, it is to be understood that many other possible modifications and variations can be made without departing from the spirit and scope of the disclosure.

What is claimed is:

1. A bag with a multiple seal system, said bag comprising: a container comprising a bottom side, a first imprinted front surface, a second imprinted rear surface, a first side surface, a second side surface and a cavity, wherein the first imprinted front surface comprises a first imprinted media, wherein the second imprinted rear surface comprises a second imprinted media, wherein said first side surface and said second side surface are disposed between the first imprinted front surface and the second imprinted rear surface and wherein said first side surface and said second side surface are integrally smooth surfaces without areas that are capable of folding the bag wherein said first side surface and said second side surface meet at a pinch point angled away from said bottom side between said bottom side and an open top wherein said pinch point provides a point of sealing for airtightness, wherein at least one of the first imprinted media and the second imprinted media comprises an imprinted braille, wherein the bottom side comprises a plurality of vertexes, wherein the plurality of vertexes connects the bottom side to the first imprinted surface, the second imprinted surface, and the plurality of side surfaces to form the cavity, wherein the cavity is configured to storing an item, wherein the cavity comprises a plurality of top edges and wherein said cavity cannot be removed through the folding of the bag; and a seal separate from and above said pinch point that is configured for preventing access to the cavity, wherein the seal comprises a male side and a female side, wherein the male side is located on a first member of the plurality of top edges, wherein the female side is located on a second member of the plurality of top edges, wherein the male side comprises a ridge, a knob, and a first handle, wherein the ridge is positioned between the knob and the first handle, wherein the female side comprises a canal, a knob receiver, and a second handle, wherein the canal is positioned between the knob receiver and the second handle, wherein the ridge engages with the canal to prevent access to the cavity, wherein the male side and the female side are detachably couplable.

2. The bag of claim 1, wherein the first imprinted media of the first imprinted surface comprises an imprinted measurement system and the second imprinted media of the second imprinted surface comprises a calendar, wherein the imprinted measurement system is configured to measure quantity of the item stored in the container, wherein the calendar facilitates tracking of storage and expiration dates of the item stored in the container.

3. The bag of claim 1, wherein said pinch points are configured to provide rigidity to the container, wherein the rigidity of the container facilitates maintenance of a container structure, wherein the container structure facilitates storage of the item in the cavity.

4. The bag of claim 1, wherein the knob is associated with a first geometric shape and the canal is associated with a second geometric shape, wherein the first geometric shape and the second geometric shape is configured for allowing maximum stiction to ensure airtightness, wherein the knob and the knob receiver is detachably couplable.

5. The bag of claim 1, wherein the ridge and the knob comprises a first material, wherein the canal and the knob receiver comprises a second material, wherein the first material is harder than the second material, wherein the second material of the canal and the knob receiver is configured for coupling with the first material of the ridge and the knob.

6. The bag of claim 5, wherein the canal and the knob receiver are configured to be coupled with the ridge and the knob using one hand by a user.

7. The bag of claim 1, wherein the bag is transparent.

8. The bag of claim 1, wherein the first handle of the male side couples with the second handle of the female side to forma combined handle for the seal, wherein the first handle and the second handle are detachably couplable.

* * * * *